United States Patent [19]

Cox

[11] Patent Number: 4,655,291

[45] Date of Patent: Apr. 7, 1987

[54] INJECTOR FOR COUPLED PIPE

[75] Inventor: Don C. Cox, Tarrant County, Tex.

[73] Assignee: Otis Engineering Corporation, Dallas, Tex.

[21] Appl. No.: 778,790

[22] Filed: Sep. 23, 1985

[51] Int. Cl.[4] ..... E21B 19/08

[52] U.S. Cl. ..... 166/385; 166/77; 166/77.5; 166/85; 226/172

[58] Field of Search ..... 166/77, 77.5, 78, 85, 166/381, 385; 226/172; 254/29 R; 474/2, 4; 198/628

[56] References Cited

U.S. PATENT DOCUMENTS

| | | | |
|---|---|---|---|
| 2,679,924 | 6/1954 | Powell | 198/628 |
| 3,191,450 | 6/1965 | Wilson | 74/219 |
| 3,215,203 | 11/1965 | Sizer | 166/77 |
| 3,258,110 | 6/1966 | Pilcher | 198/628 |
| 3,285,485 | 11/1966 | Slator | 226/172 |
| 3,313,346 | 4/1967 | Cross . | |
| 3,468,409 | 9/1969 | Ball | 198/628 |
| 3,559,905 | 2/1971 | Palynchuk | 166/77 |
| 3,610,500 | 10/1971 | Brown | 226/172 |
| 3,677,345 | 7/1972 | Sizer | 166/77 |
| 3,866,882 | 2/1975 | Willm et al. | 226/172 |
| 3,915,291 | 10/1975 | Vogts | 226/172 |
| 4,085,796 | 4/1978 | Council | 166/77.5 |
| 4,251,176 | 2/1981 | Sizer et al. | 414/22 |
| 4,508,251 | 4/1985 | Harada et al. | 226/172 |
| 4,515,220 | 5/1985 | Sizer et al. | 166/384 |

*Primary Examiner*—Stephen J. Novosad
*Assistant Examiner*—William P. Neuder
*Attorney, Agent, or Firm*—Albert W. Carroll

[57] ABSTRACT

Apparatus of the "coil tubing injector" type which is capable of running coupled pipe into or out of a well continuously. Methods are also disclosed.

33 Claims, 19 Drawing Figures

INJECTOR FOR COUPLED PIPE

BACKGROUND OF THE INVENTION

1. Field of the Invention

This invention relates to well tools. More particularly, it relates to apparatus for and methods of injecting coupled pipe into a well and removing it therefrom with an improved injector apparatus which is capable of handling both coupled pipe and coil tubing with the additional capability of rotating either of these flow conductors in a well to perform downhole operations.

2. Description of the Prior Art

It is common practice to run coil tubing into and out of wells through use of a coil tubing injector. Recently, coil tubing injectors have been improved to enable them to rotate a length of coil tubing in a well to perform downhole operations. Such improved injector made it possible to add jointed, even coupled pipe, to the upper end of coil tubing in the well and to even raise or lower the pipe/coil tubing string while being rotated. Such improved injector together with methods of treating wells employing its use is the subject of U.S. Pat. No. 4,515,220 which issued on May 7, 1985 to Phillip S. Sizer, Don C. Cox, and Malcolm N. Council for APPARATUS AND METHOD FOR ROTATING COIL TUBING IN A WELL. This patent is hereby incorporated herein for all purposes by reference thereto.

Known published prior art which may be pertinent to this present appliction includes the following U.S. Pat. Nos.

| | | |
|---|---|---|
| 3,191,450 | 3,215,203 | 3,285,485 |
| 3,313,346 | 3,559,905 | 3,677,345 |
| 3,754,474 | 4,085,796 | 4,251,176 |
| 4,515,220 | | |

U.S. Pat. No. 3,191,450 which issued June 29, 1965 to J. H. Wilson teaches means for rotating pipe while raising or lowering the same.

U.S. Pat. No. 3,215,203 issued to P. S. Sizer on Nov. 2, 1965. This patent teaches forcing jointed pipe into or out of a well through use of hydraulically powered snubbing apparatus.

U.S. Pat. No. 3,285,485 which issued Nov. 15, 1966 to D. T. Slator teaches injector apparatus for injecting coupled pipe into a well. Its pair of endless chains squeeze the pipe therebetween. Forces are applied to the chains through single-tree type linkages which offer a degree of flexibility which will permit a pipe coupling or other enlargement to pass through the device. This apparatus has not proved practical because the higher squeeze loads necessitated by high well pressures and/or great working depths cause the device to squeeze the pipe couplings so severely out of shape that the pipe string cannot be disassembled by unscrewing the threaded joints as the pipe string is removed from the well.

U.S. Pat. No. 3,313,346 which issued to R. V. Cross on Apr. 11, 1967 teaches methods of and apparatus for working in a well without a derrick through use of coil tubing and a coil tubing injection apparatus.

U.S. Pat. No. 3,559,905 issued to Alexander Palynchuk on Feb. 2, 1971. This patent teaches apparatus and methods for running sucker rods into a well and removing them therefrom continuously through use of an injection device operating in the manner of a coil tubing injector.

U.S. Pat. No. 3,677,345 which issued on July 18, 1972 to P. S. Sizer discloses apparatus and method for making up a pipe string as the string is run continuously into the well, or disassembling the string as it is removed continuously from the well.

U.S. Pat. No. 3,754,474 issued to Alexander Palynchuk on Apr. 28, 1973 and discloses gripper pads for use in drive chains in sucker rod injectors.

U.S. Pat. No. 4,085,796 was issued to Malcolm N. Council on Aug. 25, 1978 and discloses hydraulically powered apparatus for snubbing pipe into or out of a well, this apparatus having a plurality of hydraulic cylinders which can be used in various combinations to provide a range of speeds and forces.

U.S. Pat. No. 4,251,176 which issued to Phillip S. Sizer, et al. on Feb. 17, 1981 discloses a hydraulically actuated pipe snubbing apparatus wherein the length of the stroke of the pipe moving portions is equal to twice the length of the hydraulic cylinder.

U.S. Pat. No. 4,515,220 issued to Phillips S. Sizer, Don C. Cox, and Malcolm N. Council on May 7, 1985. This patent discloses a coil tubing injector and a quill therefor. This apparatus permits running coil tubing into a well to desired depth, cutting the coil tubing, placing a quill around the upper end portion of the coil tubing, adding jointed pipe to the upper end of the coil tubing, gripping the pipe with a rotating gripper on the quill, and gripping the quill in the coil tubing injector. The coil tubing can be lowered further by adding more pipe to its upper end, can be rotated by the rotatable gripper on the quill, and can, if desired, be moved longitudinally and rotatably simultaneously as required, all for performing operations downhole, such as light drilling operations for removing sand bridges and similar obstructions.

Of the prior patents discussed above, U.S. Pat. Nos. 3,285,485 to D. T. Slator, 3,559,905 to Alexander Palynchuk, and 4,515,220 to Phillip S. Sizer, et al. appear to be the most pertinent.

None of the prior art with which applicant is familiar discloses an injector device having a chain drive mechanism with two longitudinally spaced apart gripping areas either one of which is capable of gripping and driving the pipe string and being selectively, individually and independently operated, permitting each of these gripping sections to open in turn so that a pipe coupling or other similar enlargement may pass through the device, one of the gripping sections always driving the pipe while the other gripping section is opened or released to permit passage of such coupling or enlargement, the forces applied to each of the gripping areas being transmitted to the drive chains through use of pressure beams which are moved toward and away from the pipe string by hydraulic means.

U.S. Pat. Nos. 3,285,485 to D. T. Slator, 3,559,905 to Alexander Palynchuk, and 4,515,220 to Phillip S. Sizer, et al. are hereby incorporated herein for all purposes by reference thereto.

SUMMARY OF THE INVENTION

This invention is directed to apparatus for injecting pipe or tubing into a well, this apparatus comprising a frame in which a pair of opposed endless drive chains are disposed in a common plane in spaced apart relation to provide therebetween a pathway for pipe, and each with an upper and lower pressure beam therewithin, the upper pressure beams being spaced apart and being movable toward and away from the pathway to apply a gripping force to the pipe in the pathway or to release such gripping force, the lower pressure beams operating exactly like the upper pressure beams, the upper pressure beams being actuatable independently from the lower beams, and vice versa, and means for driving the drive chains in either direction to drive pipe or tubing into or out of a well, couplings or other similar enlargements in the pipe being moved through the injector apparatus by opening the first gripping area while driving the pipe until the coupling or similar enlargement reaches the non-gripping area between the two gripping areas, then engaging the first gripping area and afterwards releasing the second gripping area to permit the coupling or similar enlargement to pass on through the apparatus, the pipe or tubing not necessarily stopping during the time the coupling or similar enlargement is passing through the injector apparatus.

The methods are directed to running a pipe string into or removing it from a well using a pipe injection apparatus capable of engaging and gripping the pipe at upper and lower spaced apart gripping areas, the steps including assembling the pipe string, gripping the pipe string in said apparatus at the lower gripping area, operating the apparatus to force the pipe string into the well until the first coupling reaches the nongripping area between the upper and lower gripping areas, gripping the pipe string at the upper gripping area, then releasing the lower gripping area to allow the coupling to be moved on through the apparatus, thus moving couplings through the apparatus without the apparatus having to engage a coupling in its grip.

It is therefore one object of this invention to provide a pipe or tubing injector for moving pipe or tubing into or out of a well.

Another object is to provide such an injector wherein its chain drive mechanism grips the pipe or tubing in two spaced-apart areas and is capable of gripping the pipe or tubing in either or both such locations selectively, as desired.

A further object is to provide such apparatus having hydraulic means for causing engagement and disengagement of the pipe or tubing.

Another object is to provide such apparatus having pressure beams for pressing its drive chains against the pipe string and having anti-friction rollers interposed between the beams and the chains.

Another object is to provide pipe injection apparatus of the character just described having the opposed upper pressure beams mechanically linked together and the opposed lower pressure beams mechanically linked together in such manner that these beams will at all times be centered relative to the pathway therebetween so that each such pressure beam will move an equal distance in engaging and releasing the pipe.

Another object is to provide such pipe injection apparatus having hydraulically powered interlock means which will allow the upper or the lower pressure beams to retract to pipe releasing position only if the other pressure beams are in pipe engaging position, and then only if the such beams are applying adequate gripping power to the pipe.

A further object is to provide such apparatus having sensor means and means for releasing the pipe at one of the gripping areas in response to a pipe coupling being sensed by the sensor means.

Another object is to provide such apparatus having such hydraulic linking means which includes coupling sensor means and timing means for sensing arrival of pipe couplings at the apparatus and will cause the upper and lower pressure beams to open and close in sequence in order to allow the pipe coupling to pass through the apparatus without ever being gripped therein.

A further object is to provide such apparatus having such sensor means which includes hydraulic circuitry for sequencing opening and closing of the pressure beams so that pipe couplings can pass through the injection apparatus automatically without stopping progress of the pipe because of those couplings.

Another object is to provide apparatus of the character described having sensing means and sequencing circuitry for allowing couplings to pass through the apparatus automatically in either longitudinal direction.

Another object is to provide such apparatus having hydraulic upper and lower coupling sensor means and switching valve means for reversing the sequencing of the operation of the interlock means so that, during removal of the coupled pipe from the well, the pipe couplings will be sensed and the opening and closing of the upper and lower pressure beams will be sequenced so that the pipe couplings will be allowed to pass through the injector without ever being gripped by the gripping mechanism and this even without stopping the movement of the pipe.

Another object is to provide selective limit means for limiting the width of the pathway between the opposed pressure beams when they are in pipe releasing position, so that when pipe is being handled, the pressure beams will open only enough to allow pipe couplings to pass therebetween, but when the quill means is used, the pressure beams may be retracted sufficiently to permit the quill to be installed in and removed from its operating position.

Another object is to provide quill means for surrounding the pipe and being grippable in the injection apparatus so that the pipe can be rotated within such quill means.

Another object is to provide such quill means with gripping means for engaging and supporting the pipe extending through the quill while the quill is supported in the injection apparatus.

Another object is to provide means for swivelly mounting such gripping means upon the quill means so that the pipe may be running coupled pipe into a well using a pipe or tubing injector without the need for engaging the coupling with the drive chain mechanism of the injector apparatus.

Another object is to provide such method wherein the injection apparatus has gripping areas which are engaged and disengaged in sequence to permit the pipe couplings to pass through the apparatus without damage to the coupling or apparatus.

Another object is to provide a method of running coupled pipe into or out of a well including automatic sequencing of the apparatus so that the apparatus need not be stopped when a coupling is encountered.

Another object is to provide a method of running coupled pipe into a well including rotating the pipe while it is lifted or lowered in the well by the pipe injection apparatus.

Another object of this invention is to provide means for spreading apart the drive chains in the non-gripping area of the apparatus to avoid contact of such chains with a pipe coupling passing therethrough.

Another object is to secure such spreading means to the frame of the apparatus and have a spreader member projecting between the outer edges of the drive chains to spread them apart to clear the pipe couplings as they pass through the apparatus.

Other objects and advantages will become apparent from reading the description which follows and from studying the accompanying drawing, wherein:

DESCRIPTION OF THE PREFERRED EMBODIMENT

Figure 1:
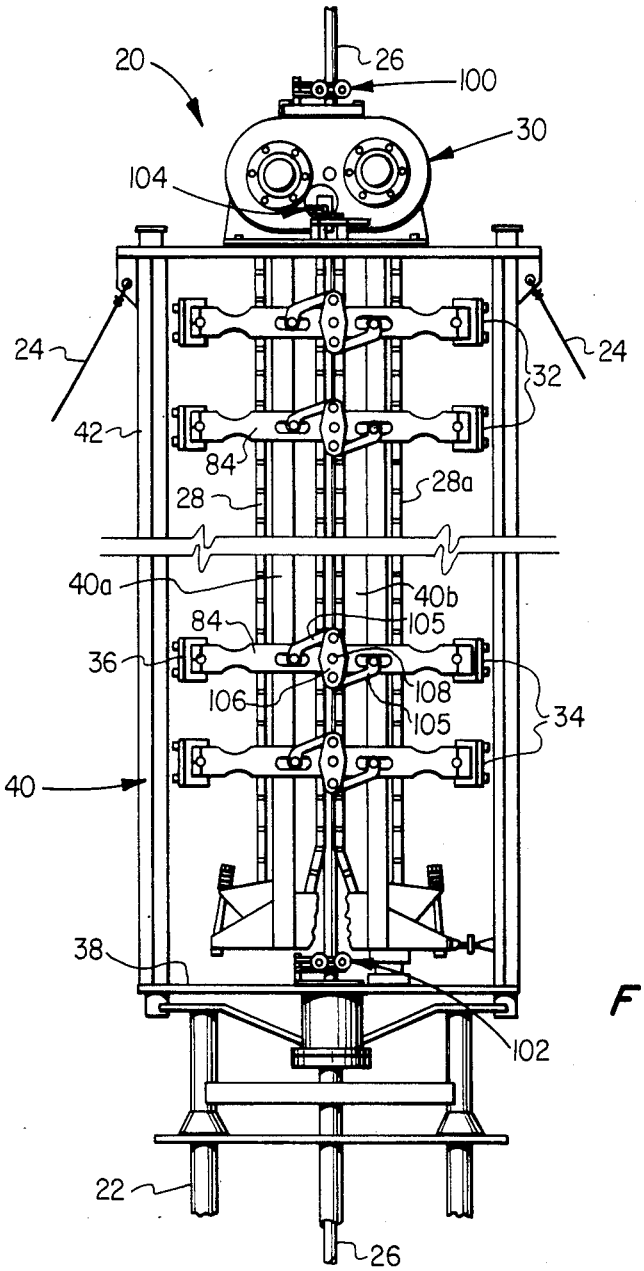
FIG. 1 is a schematical side elevational view of a pipe injecting device having upper and lower gripping areas.

Referring now to FIG. 1, it will be seen that the pipe injection apparatus of this invention is shown schematically and that it is indicated generally by the reference numeral 20.

The apparatus 20 is supported upon a plurality of legs 22 which are in turn supported upon a platform or plate (not shown) mounted together with a stripper head (not shown) and stationary slips (not shown) upon a conventional Christmas tree (not shown) in the manner taught in U.S. Pat. No. 4,515,220 to Phillip S. Sizer, et al., and which is incorporated herein by reference.

The apparatus 20 is stabilized in the vertical position shown in FIG. 1 by a suitable number of guy lines 24.

A work platform (not shown) is normally mounted atop the apparatus to support workers and ancillary equipment such as a control console, and the like. Further, a gin pole and hoist (not shown) are normally provided to handle pipe and other objects. The work platform and the gin pole and hoist have been omitted from the drawing because they are not required to illustrate the claimed invention and because they are clearly shown in the aforementioned U.S. Pat. No. 4,515,220 which has been incorporated into this present application by reference.

Apparatus 20 is useful in running pipe or tubing 26 into or out of a well. The tubing may be coiled tubing, or it may be jointed tubing or pipe such as pipe sections connected together with collars or couplings or other type having enlarged sections at the threaded connections.

The pipe string 26 passes through the apparatus 20 and is held in the grip of a pair of opposed drive chains 28 and **28*a* disposed in a common plane and which have portions thereof which are forced against the pipe for frictional gripping engagement therewith. The drive chains 28 and 28*a* are driven by a transmission 30 having sprockets over which the chains travel. The transmission is powered by pressurized hydraulic fluid or other suitable means. The chains are drivable in a direction to move the pipe 26** into the well, or to move the pipe out of the well, as desired. Pressurized hydraulic fluid also is used to power the mechanism for gripping or releasing the pipe and to power other equipment such as slips and the like.

The gripping mechanism includes an upper set of hydraulic actuator cylinders 32 and a lower set of hydraulic actuators 34. Preferably, each such set of actuators includes actuators, such as actuator 36, or both the left-hand and the right-hand sides, as shown.

The apparatus further includes a frame 40 including a floor plate 38 and a plurality of legs 42 supported thereon.

The pipe string may be assembled as it is run into the well, or it can be fed from a reel or basket via suitable guide means to the appartus.

Figure 2:
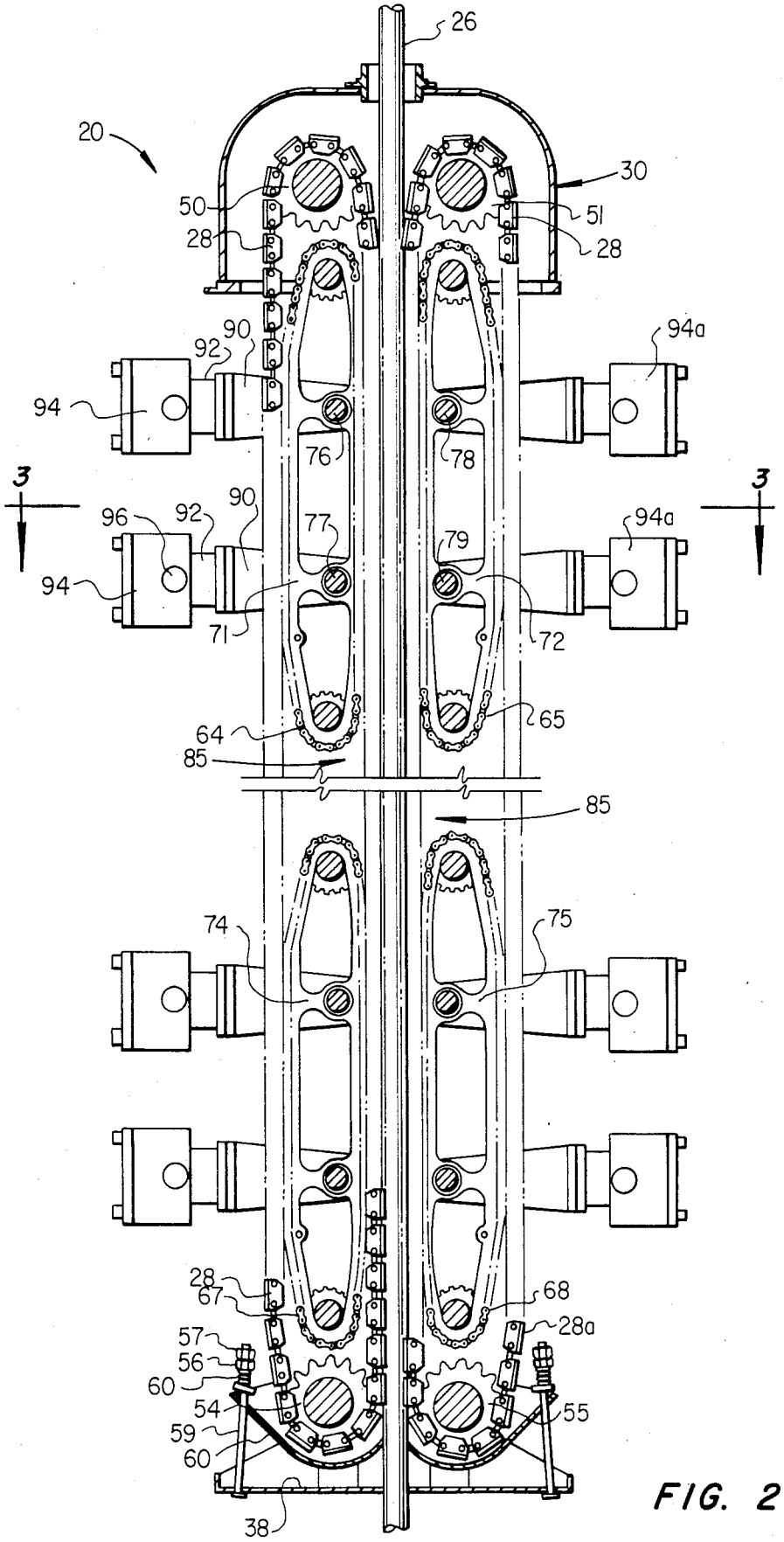
FIG. 2 is a side elevational view of a pipe injecting device embodying the present invention and having a fragmentary section of pipe engaged therein.

Referring now to FIG. 2, the pipe injector apparatus 20 is seen in greater detail. In FIG. 2, the frame 40 and legs 42 (seen in FIG. 1) are not shown.

The apparatus of FIG. 2 is shown with a length of pipe 26 engaged therein. This apparatus is seen to be provided with a pair of endless drive chains 28 and **28*a* which are shown on the left-hand and right-hand side, respectively, of the pipe 26. These drive chains are driven by sprockets 50 and 51 which are a part of the transmission 30. A pair of lower sprockets 54 and 55 are engaged in the lower loop of the chains and they are pivotally mounted to provide for adjustment in the tension of the chains. To tighten chain 28, for instance, the nuts 56, 57 are tightened on bolt 59, anchored in floor plate 38, against the spring washers 60 to swing the housing 60 downward about a pivot (not shown), the sprocket 54 being rotatably mounted in housing 60. In a similar manner, tension on chain 28*a*** may be adjusted as desired.

Inside left and right drive chains are left and right upper roller chains 64 and 65, respectively, and left and right lower roller chains 67 and 68, respectively.

Within each roller chain is a pressure beam. Thus there are left and right upper pressure beams 71 and 72 and left and right lower pressure beams 74 and 75, respectively. Each roller chain fits freely about the periphery of its pressure beam as shown. Each roller chain is composed of rollers connected together by link and pins in the well-known manner.

The pressure beams are movably mounted. For instance, the upper pressure beams 71 and 72 are movable toward and away from each other as are the lower pressure beams 74 and 75 also.

When the pressure beams (upper, lower) are moved toward each other, each pressure beam exerts a force against its roller chain and this roller chain bears against the drive chain to force it against the pipe 26. Thus, when the upper pressure beams 71 and 72 are forced inward toward each other, the pipe 26 is squeezed or gripped between the drive chains 28 and 28*a*. The amount of squeeze or grip is understandably dependent upon the force with which the pressure beam is pressed against the roller chain by the actuator cylinders 94 and 94*a*.

The pressure beams are provided with trunnions whose ends are slidable in slots in side plates. For instance, the upper pressure beams 71 and 72 each have upper and lower trunnions. Upper left pressure beam 71 has upper and lower trunnions 76 and 77, respectively, while the upper right pressure beam is provided with upper and lower trunnions 78 and 79, respectively.

Figure 3:
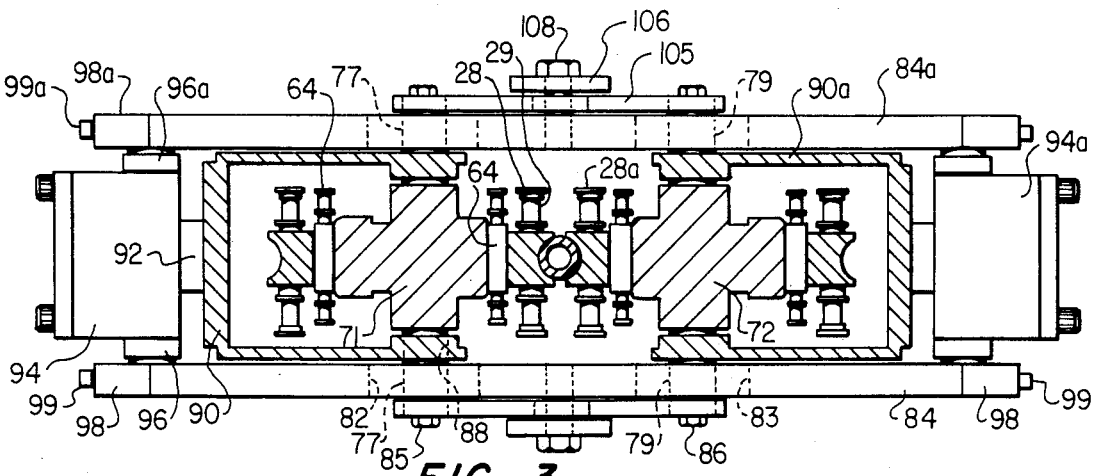
FIG. 3 is a cross-sectional view taken along line 3—3 of FIG. 2.

As seen in FIG. 3, lower trunnions 77 and 79 of upper pressure beams 71 and 72 have their outer ends disposed in horizontal slots 82 and 83, respectively. Thus, the pressure beams having their trunnions slidably disposed in such slots formed in side plates 84 and 84*a* are enabled to move toward and away from each other. Screws 85 and 86 screwed into the ends of trunnions 77 and 79 hold washers in place thereon and the washers are somewhat greater in diameter than the width of the slots. Thus, they retain the trunnions in place relative to side plates 84 and 84*a*.

The trunnions on the pressure beams each pass through an opening in the end of a yoke and the yoke is attached to a piston/cylinder. Thus means are provided for powering the pressure beams toward and away from each other. For instance, trunnion 77 of pressure beam 71 passes through opening 88 of yoke 90. Yoke 90 is attached to piston rod 92 of piston cylinder 94 which has trunnions 96, 96*a* which are mounted at the junction of side plate 84, 84*a* with end pieces 98, 98*a* held in place by screws 99, 99*a*. Piston/cylinder 94 moves the yoke 90 and pressure beam 91 connected thereto toward and away from pipe 26, as desired. The beam pushes the drive chain against the pipe to frictionally engage and grip the pipe either to hold it against movement or to impart movement thereto, as the case may be. To render driving of the pipe easier and thus require less horsepower, the rollers 64*a* of the roller chain 64 being disposed between the pressure beam 71 and the drive chain 28 minimizes the friction therebetween.

In a similar manner, pressure beam 72 is moved by yoke and piston/cylinder 94*a* toward and away from pipe 26. Thus, when piston/cylinders 94, 94*a* are actuated in one direction, pressure beams 71 and 72 move toward each other and the pipe 26 is gripped between the drive chains 28 and 28*a*. Similarly, when the piston/cylinders 94, 94*a* are actuated in the opposite direction, pressure beams 71, 72 move away from each other and release their grip on the pipe 26.

It can be readily seen that the upper pressure beams 71, 72 provide what may be referred to as an upper gripping area constituting that area where the drive chains grip the pipe tightly when the upper pressure beams ar moved toward the pipe.

It might be said that the drive chains, which resemble tracks, are closed when they are in gripping engagement with the pipe and that the drive chains or tracks are opened to disengage or release their grip on the pipe.

Figure 4:
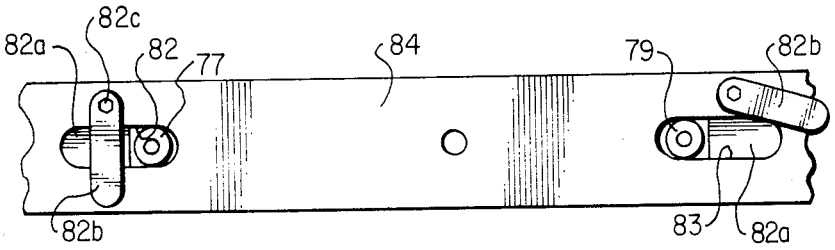
FIG. 4 is a fragmentary view showing a side plate of the apparatus of FIG. 1 with stop blocks in its slots for limiting movement of the trunnions therein.

Opening of the drive chains or tracks may be limited by suitable means, such as by the yoke (yoke 90, for instance) engaging the cylinder of the piston/cylinder 94, or preferably, for some, allowing the trunnions to engage the end of the slots 83 in the side plates 84, 84*a*. Closing of the drive chains or tracks is limited by their engagement with the pipe or other object therebetween, or if no object is present therebetween, by engagement of the pressure beam trunnions with the inner ends of the slots 83 in the side plates 84, 84*a*. To limit the retraction of the pressure beams when it is unnecessary to open the tracks to their fullest, as in some operations, spacers or stop blocks may be used in the slots 83, or between the yokes and cylinders, if desired. This will save wasting of energy and time, as well as the needless generation of heat. In FIG. 4, there is shown a stop block or spacer positioned in a slot 83 to thus limit the outward travel of the pressure beam.

It is understood that the piston/cylinders and yokes act simultaneously upon both upper and lower trunnions of the upper left and right pressure beams to open and close the tracks to engage and disengage the pipe.

In the same manner as just described, the lower pressure beams 74 and 75 are moved toward and away from each other by yokes and piston/cylinders, which are exactly like those just described, to grip and release the pipe by closing and opening the tracks or drive chains as described above. The lower pressure beams 74 and 75 cause the drive chains to grip or engage the pipe along a region which may be termed the lower gripping area. The upper and lower gripping areas are alike and are of equal length since the upper and lower pressure beams are identical, as are the components associated therewith.

The upper gripping area is spaced above the lower gripping area an appreciable distance, providing a non-gripping or neutral area 85 therebetween. This distance of 25 to 60 inches (63.5 centimeters to 152.4 centimeters) should be adequate for most purposes, with 40 to 44 inches (101.6 centimeters to 111.76 centimeters) being perhaps a good compromise.

The drive chains or tracks can be caused to engage and disengage the pipe in the upper and lower gripping areas selectively and independently of each other. Thus by opening the upper gripping area and leaving the lower gripping area closed on the pipe, the pipe can be moved downwardly until a coupling or enlargement thereon passes through the upper gripping area and is safely in the non-gripping or neutral area therebelow. When the coupling or other enlargement is in this non-gripping area, the upper gripping area can be closed to engage the pipe, after which the lower gripping area can be opened to permit the coupling to pass therethrough. Then, after the coupling clears the tracks, the lower gripping area can be closed again after which the upper gripping area can again be reopened upon the arrival of the next coupling. Thus, coupling after coupling can be passed through the apparatus without ever being gripped in the upper or lower gripping areas of the drive chains.

It is important when running or pulling pipe never to open both upper and lower gripping areas at one time lest the pipe uncontrollably blow out of the well or fall thereinto, unless, of course, the pipe is held by other means such as slips, or the like (not shown). For this reason, it is recommended that an interlock mechanism be provided which will permit either one of the gripping areas to be opened only when the other gripping area is closed.

Such interlock mechanism is provided. This mechanism permits coupled pipe to be run into or out of a well with facility since it includes upper and lower coupling sensors, one above and the other below the injector mechanism, and a timer control mechanism. The sensors sense the arrival of a pipe coupling at the injector and initiate the timer control mechanism which causes the injector's two gripping areas to open in turn to allow the coupling to pass therethrough without stopping the pipe string.

This interlock mechanism will now be described.

The interlock mechanism includes an upper coupling sensor 100, seen in FIG. 1, which senses pipe couplings arriving at upper end of the pipe injector 20, a lower coupling sensor 102 which senses pipe couplings arriving at the pipe injector from below, and a timer control mechanism 104 mounted on the transmission near the upper end of the injector. This interlock mechanism is powered by fluid pressure, however, a small part of it is powered by air pressure, as will be brought to light.

It should be understood that the upper and lower pressure beams may be retracted much further than is necessary to clear the couplings or other normal enlargements in the pipe string. For instance, if the pipe string is composed of 1 inch pipe (2.54 centimeters), then the pressure beams need be retracted only about ¼ inch (0.635 centimeter) in order to allow the pipe coupling to pass through the injection apparatus. The slots, such as slots 82 and 83, in the side plates, such as side plate 84, in which the trunnions, such as trunnion 77 and 79, operate are sufficiently long to allow the pressure beams to be retracted a full 4 inches (10.16 centimeters) to accommodate a quill as taught in U.S. Pat. No. 4,515,220, incorprated herein. Full retraction of the pressure beams may be limited either by the trunnion engaging the end of the slot in the side plate or can be limited by the yoke, such as yoke 90, coming into contact with its actuator, such as actuator 94. The matter of which one will actually provide the limiting may ordinarily be dependent upon the build-up of tolerances in the manufacture of the various parts.

Referring now to FIG. 4, it will be seen that simple means is provided for limiting the retraction of the pressure beams to a distance which will just clear the pipe couplings. In FIG. 4, it will be seen that the side plate 84 is shown in fragmentary view and that the bell crank 106 and links 105 have been removed to show that the slot 82 in which the trunnion 77 operates is partially filled with a limiting block or stop block **82*a* held in place by a cover 82*b* pivotally supported in place by a bolt 82*c* screwed into the side plate 84. The yoke 90 supports the stop block in the slot from the back side. The free-swinging cover 82*b* is loosely mounted, and gravity will move it to and hold it in the pendant position shown. However, the cover can be freely swung aside as shown in the dotted lines so that the stop block 82*a* can be removed whenever it is desired to retract beams further than ordinarily needed to pass a coupling. Thus, when the cover is swung to the side and the stop block 82 is removed, the slot 82 is again unrestricted and the pressure beams can be retracted to the fullest. With the stop block in place as shown as in FIG. 4, the pressure beams can be retracted only until the trunnions strike the face of the stop blocks to limit retraction of the pressure beams. This, of course, conserves energy, reduces fuel consumption, and lessens the wear and tear on the equipment. Equally important, it speeds up the operation because the movement is reduced to a minimum. In the same manner, each of the other slots in the side plates is provided with a stop block, such as the stop block 82*a*, and with a cover such as cover 82*b***. These stop blocks will normally be in place in the slots and removed only when the quill is to be used. The quill and its purpose will be described later.

In order to assure that each set of opposed pressure beams will work in unison and that they will maintain equal distances from the centerline of the injection apparatus, the opposed pressure beams are linked in a manner as will now be described. Referring again to FIG. 1, it will be seen that the ends of the trunnions are linked together by arms such as link 105. Each of the links 105 has one end thereof attached to a trunnion, while the other end of each of the arms 105 is attached to the outer end of a double-ended lever or bell crank 106 pivotally mounted as by bolt 108 to the side plate. The links 105 are equal in length, and they are attached to the bell crank 106 at equal distances from the bolt 108. Therefore, when the trunnions move toward and away from the centerline, they, being linked together, must move equal distances. In this manner, the pressure beams will always act to remain equidistant from the centerline of the injection apparatus. This in turn assures that the opening between the pressure beams and therefore between the drive chains will be straight.

Figure 5:
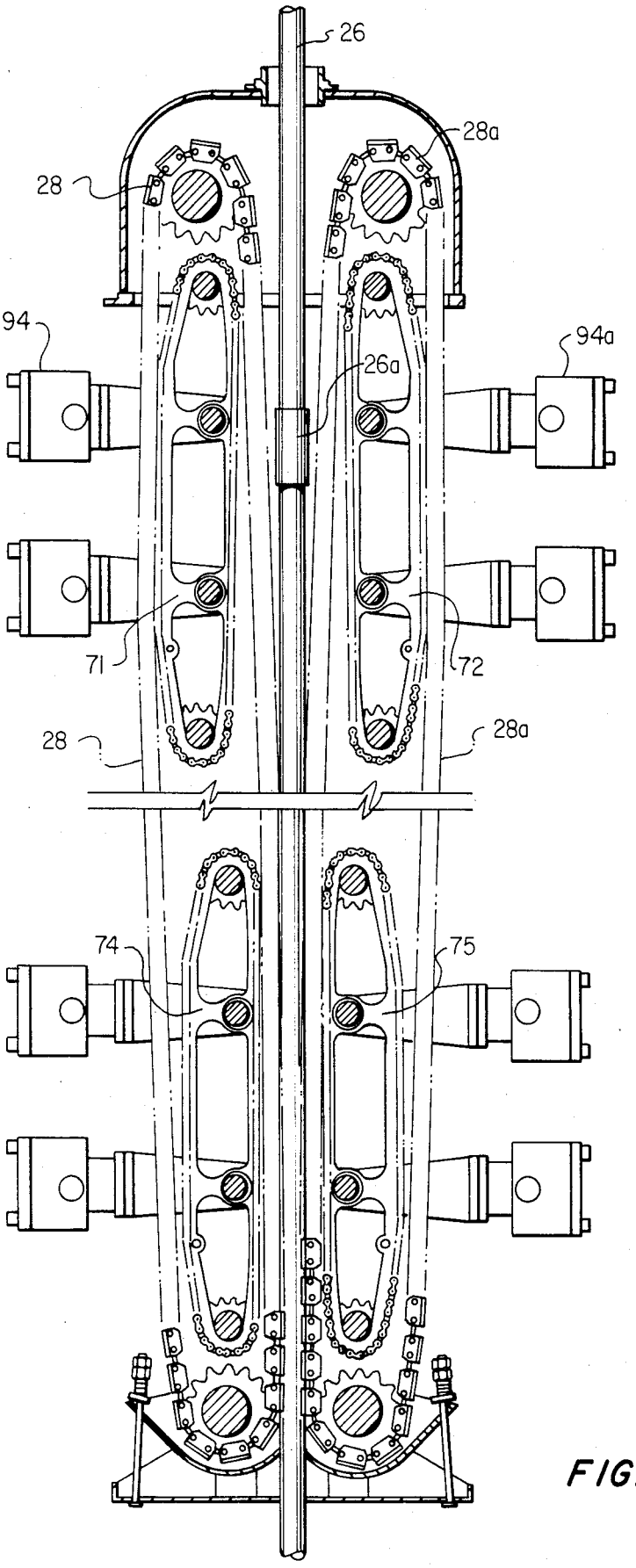
FIG. 5 is a view similar to FIG. 2 showing a coupling of a pipe string passing through the upper gripping area of the pipe injection apparatus.
Figure 6:
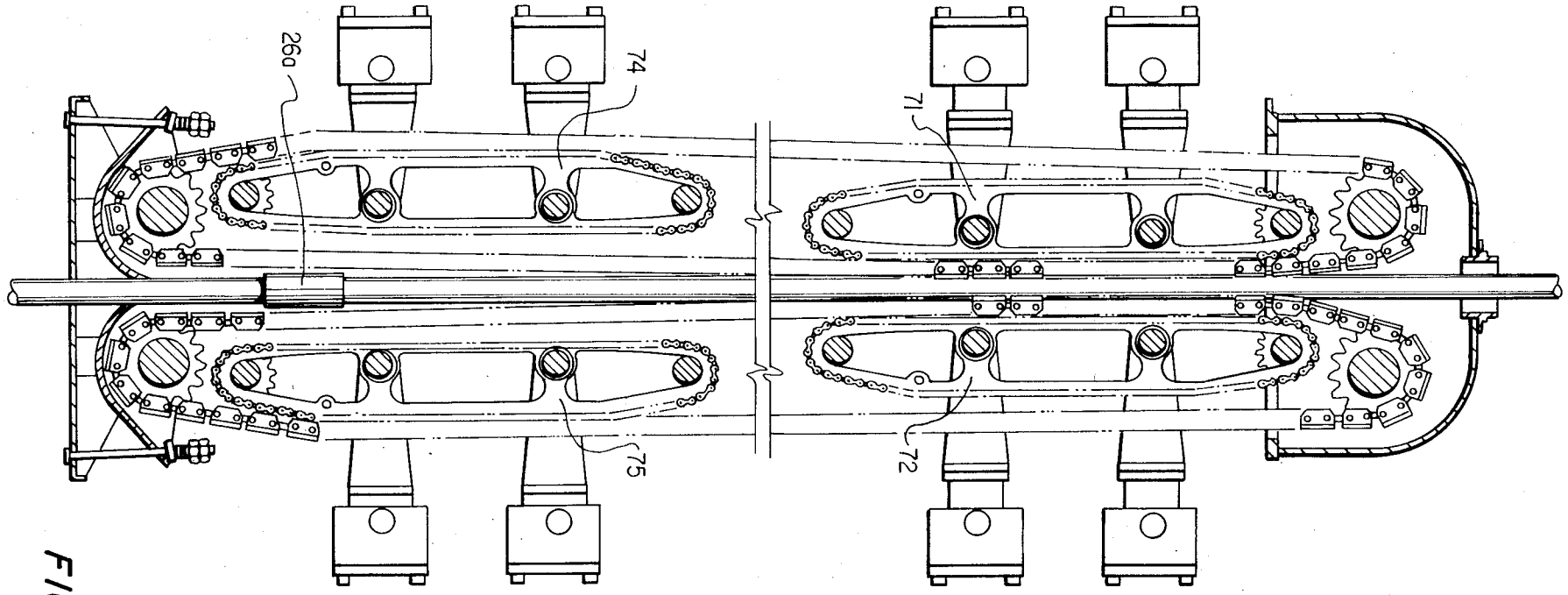
FIG. 6 is a view similar to FIG. 5 but showing the pipe coupling passing through the lower gripping area of the pipe injection apparatus.

Referring now to FIG. 5 of the drawing, it will be seen that the pipe injection apparatus 20 has its upper pressure beams 71 and 72 retracted to allow a coupling **26*a* in pipe string 26 to pass therebetween. The upper pressure beams 71 and 72 have been retracted automatically as a result of the coupling 26*a* having been detected or sensed by the upper sensor 100 which through hydraulic circuitry and equipment not yet explained has caused the upper beams to retract. When the pipe coupling 26*a* reaches a non-gripping area between the upper and lower gripping areas, the upper pressure beams will again be actuated to again engage the pipe to support it and to drive it downwardly into the well. At this time, the pipe injection apparatus would be in the mode seen in FIG. 2 wherein both the upper and lower pressure beams would be in pipe engaging position, the only difference being that now there would be a pipe coupling in the non-gripping area. Before the pipe coupling 26*a* reaches the lower gripping area, the lower pressure beams 74 and 75 will be retracted automatically to allow the pipe coupling to pass therebetween as is seen in FIG. 6. When the coupling 26*a* is sensed by the lower sensor 102 near the lower end of the injection apparatus, the lower pressure beams 74 and 75 will again be extended to pipe-gripping position so that the pipe injection apparatus will again be in the mode as seen in FIG. 2 wherein both the upper and lower gripping areas are gripping the pipe. When the next coupling such as coupling 26a is sensed by the upper sensor 100**, a cycle like that just described will be initiated, and that coupling also will be allowed to pass first through the upper gripping area and then the lower gripping area.

In a similar manner, as the pipe is being withdrawn from the well and couplings approach the injection apparatus from below, the lower sensor 102 will be engaged by the pipe coupling, and the lower pressure beams 74 and 75 will be retracted to allow the coupling to pass upwardly therebetween and enter the non-gripping area. Then the lower pressure beams 74 and 75 will be actuated to pipe-gripping position after which the upper pressure beams 71 and 72 will be retracted to allow the coupling to pass upwardly therebetween. When the coupling engages the upper sensor 100, the upper pressure beams again will be actuated to pipe-gripping position, and the pipe will then be supported and driven by both the upper and the lower gripping areas, as seen in FIG. 2.

It is readily seen that it is important to always have one of the gripping areas engaged so that the pipe will be either supported against blowout or supported against pipe falling into the well, or in order to move the pipe up or down. The mechanism for interlocking the upper and lower gripping areas so that one cannot be retracted unless the other is engaged is incorporated into the hydraulic mechanism which also includes the sensors 100 and 102 previously described.

Figure 7:
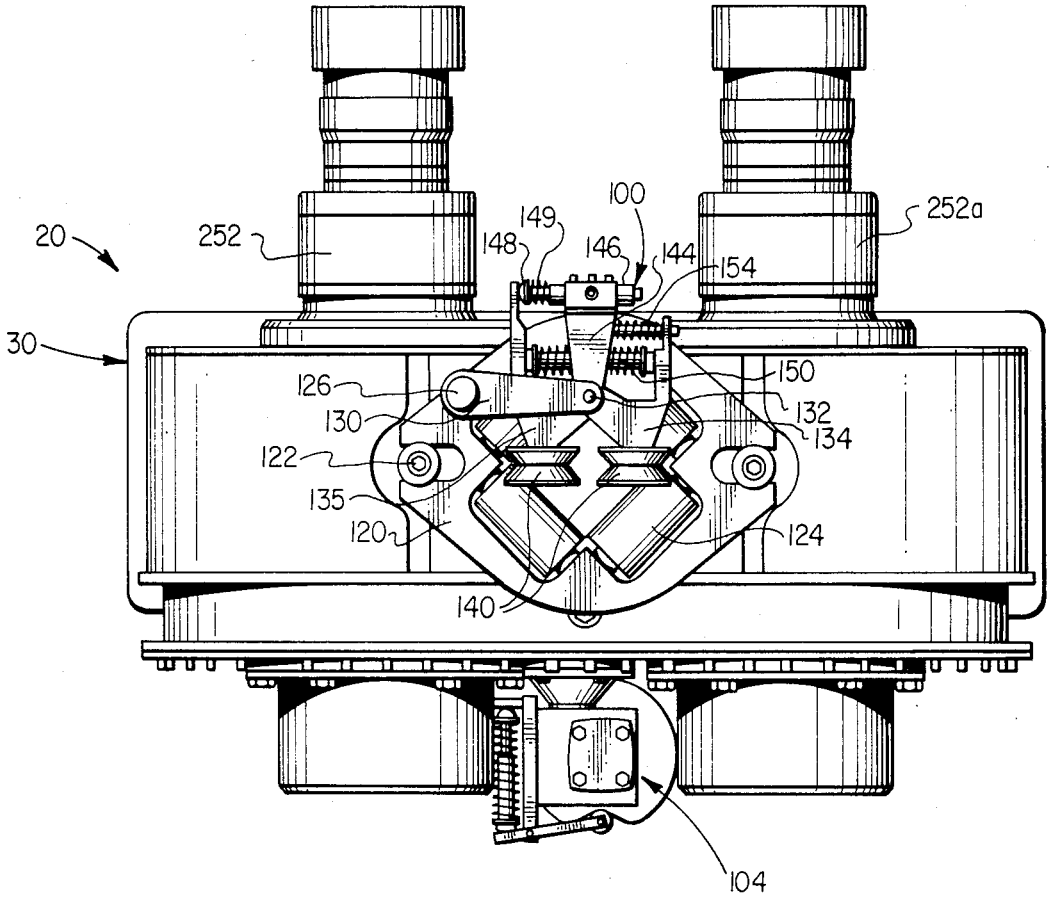
FIG. 7 is a top view of the transmission of the pipe injection apparatus of FIG. 2 through 6 showing a coupling sensor mechanism mounted atop thereof and a time mechanism mounted on the side thereof.

The hydraulic circuitry and equipment which senses the arrival of a coupling approaching the apparatus either from above or below and in response thereto initiates a cycle which will cause the upper and lower gripping areas to open and close in the proper sequence in order to allow the coupling to pass through the apparatus without being gripped or without being damaged by the gripping mechanism, and perhaps to move through it without having to be stopped anywhere along the way will now be described. FIG. 7 shows a top view of the pipe injection apparatus 20 with the upper sensor 100 mounted thereon and the timer 104 mounted on the side thereof.

The upper sensor 100 is preferably mounted onto a heavy plate 120 secured atop the transmission 30 by a pair of bolts 122, the plate having an opening therethrough in which four rollers 124 are arranged and mounted as shown providing a square opening therewithin for a purpose to be described but which the pipe will pass through into the injection apparatus. The sensor 100 is mounted on a post 126 so that the sensor mechanism 100 is spaced above the square opening between the rollers 124. The sensor includes an arm 130 which is swivelly mounted on the post 126 and has a pivot pin 132 passing through its outer end. A pair of arms 134 and 135 are pivotally mounted about the pivot pin 132, and on this pair of arms a pair of V pulleys 140 is mounted to form a small opening therebetween through which the pipe will pass on its way into or out of the injection apparatus 20. Also mounted by pivot pin 32 is a central support arm 144 on the outer end of which is fastened a hydraulic valve 146 as shown. Valve 146 includes a plunger actuator 148 which is spring-loaded by spring 149. A suitable spring-loaded plunger 150 is mounted between the arms 134 and 135 so that the compression in the spring tends to pivot the arms 134 and 135 around the pivot pin 132 to bias the pair of V pulleys 140 closer together. This action may be limited by suitable means.

When a pipe coupling passes between the two V pulleys 140, the V pulleys are forced apart causing the opposite ends of arms 134 and 135 to move closer together. When this occurs, one of the arms will depress the plunger 148 of the hydraulic valve 146 and cause it to be actuated. The valve 146 is resiliently mounted so that the impacts of the arms will not damage it, and this is accomplished by mounting a spring 154 between the arm 144 and the arm 134 as shown. A bolt passes through the arm 134 and spring 154 and is screwed into a lug or a nut welded on the bottom side of the arm 144.

Figure 9:
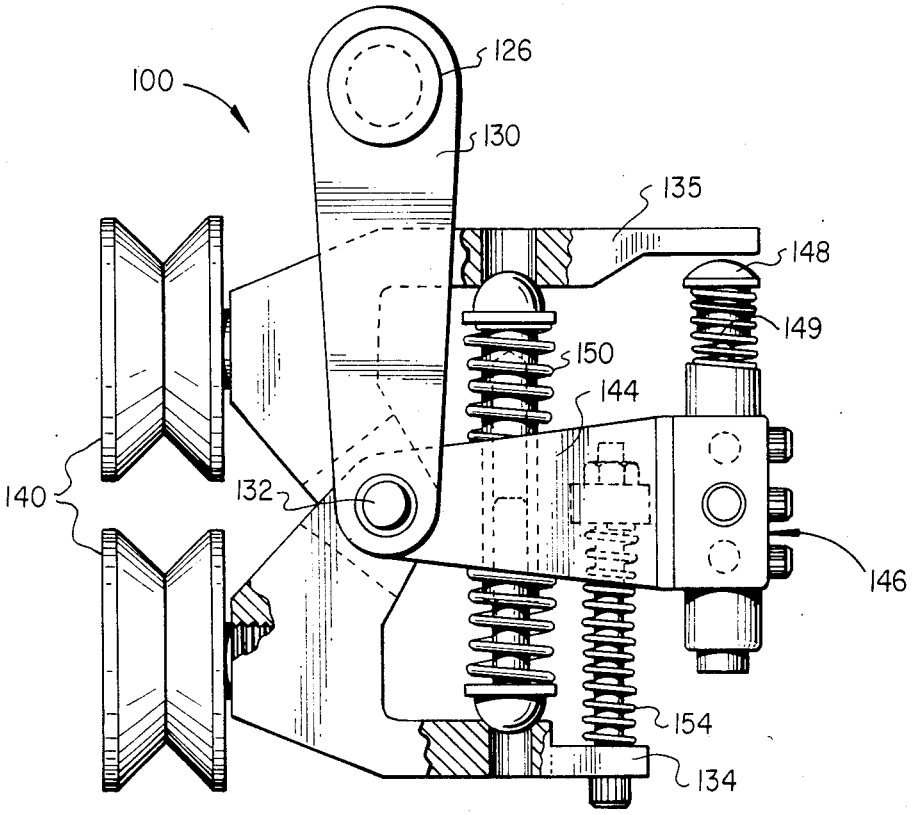
FIG. 9 is an enlarged plan view of the coupling sensor seen in FIG. 7.

As soon as the coupling has passed through the V pulleys 140, the spring and plunger 150 return the sensor to its normal condition shown in FIGS. 7 and 9.

Figure 8:
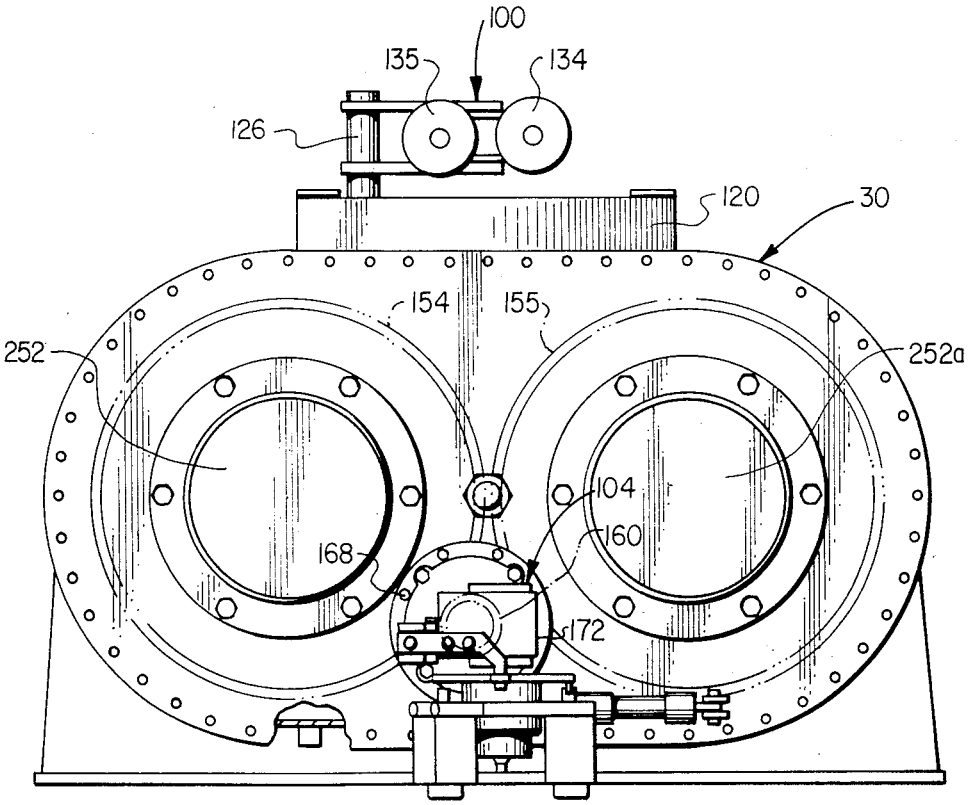
FIG. 8 a side view of the transmission seen in FIG. 7.

FIG. 8 is a side view of the transmission showing the timer 104 mounted thereon. The timer is better seen in FIGS. 10, 11 and 12.

The transmission which drives the two drive chains is provided with a pair of side-by-side hydraulic motors 252 and 252a (FIG. 7) synchronized by a pair of meshed timing gears 154 and 55, seen in FIG. 8. These motors drive the chain sprockets 50 and 51 (seen in FIG. 2) and thus drive the chains 28 and 28a. The timing gears 154 and 155 being meshed assure that equal power will be delivered to the two drive chains and that these two drive chains will be driven at exactly the same speed so that as they drive the pipe in or out of the well, there will be no slipping or scarring of the pipe.

Figure 12:
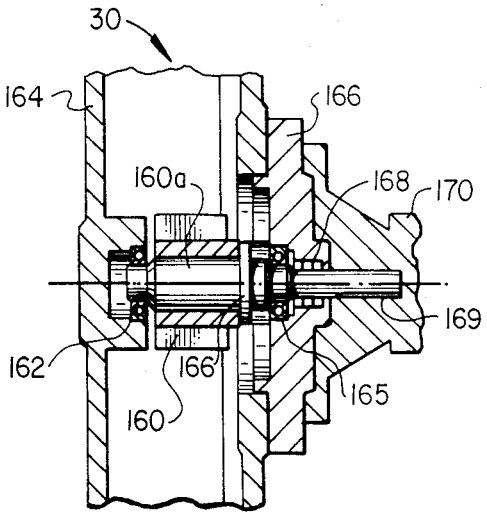
FIG. 12 is, a fragmentary sectional view showing the gear mechanism which drives the transmission of the timer mechanism seen in FIGS. 10 and 11.
Figure 13:
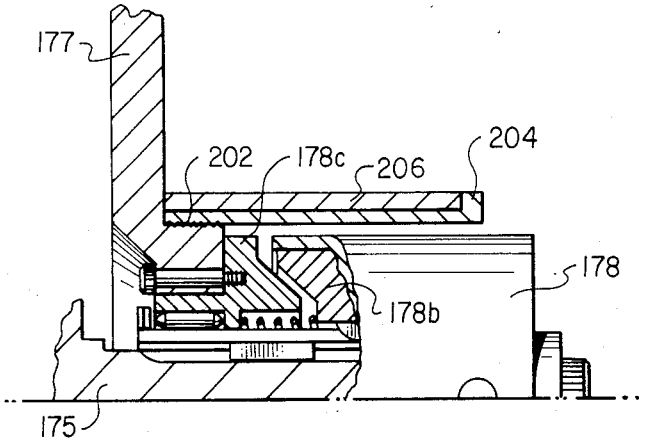
FIG. 13 is a fragmentary view, partly in section and partly in elevation with some parts broken away, showing the clutch mechanism which drives the timing wheel of the timer mechanism.
Figure 10:
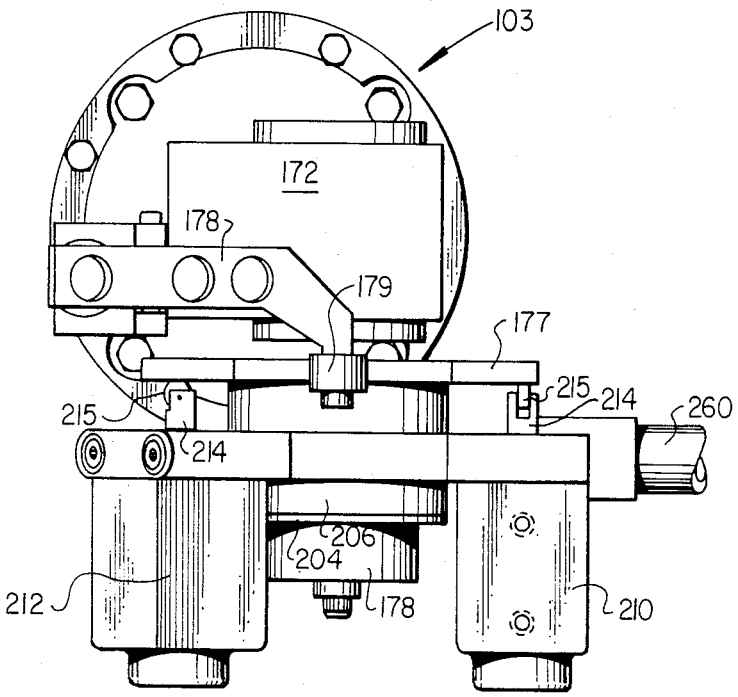
FIG. 10 is an enlarged side view of the timer mechanism of FIG. 8.
Figure 11:
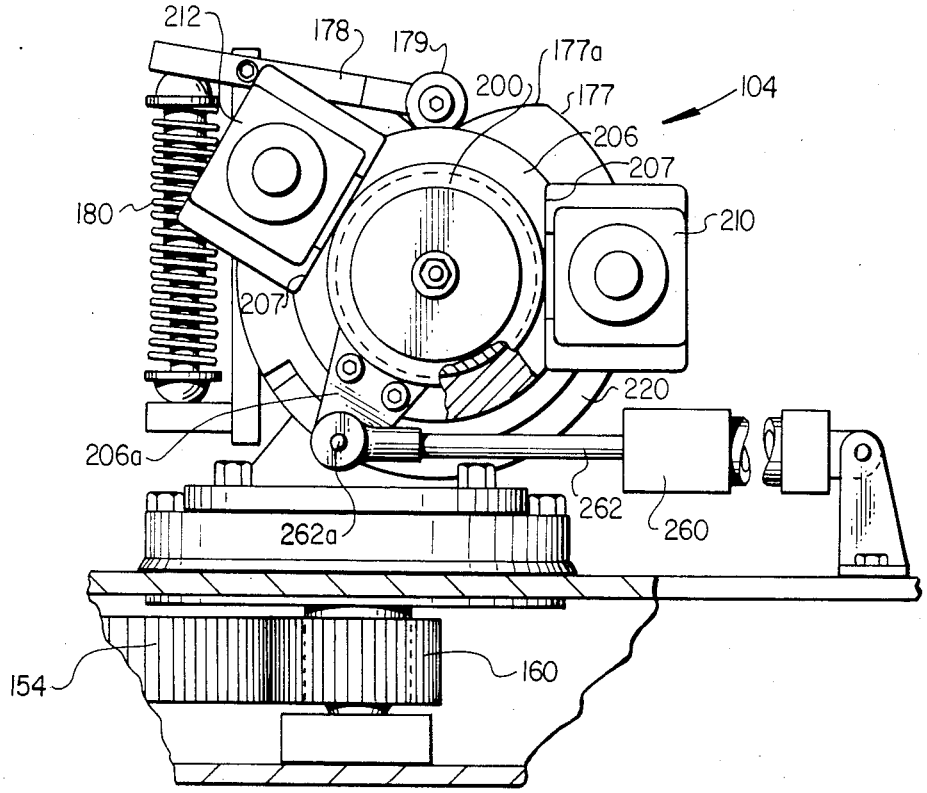
FIG. 11 is a bottom view of the timer mechanism of FIG. 10.

Timing gear 154 also drives the timer 104. The driven gear 160 of the timer is shown in FIG. 12. This gear 160 has its inward end mounted in a suitable bearing 162 mounted in one of the walls 164 of the transmission 30 and the other end of the gear 160 is supported by a bearing 165 mounted in the adapter plate 166 of the timer which is attached as by bolts or screws 168 (shown in FIG. 8.) If preferred, gear 160 can be a commercial gear mounted on shaft 160a and secured by a pin such as the pin 166. The outer end of the shaft 160a passes through a suitable seal 168 and is provided with a keyway 169. The keyway 169 receives a key not shown by which the worm gear 170 is attached to the end of the shaft 160a to be positively driven thereby. The worm gear 170 is a part of the timer transmission or gear box 172 (FIG. 8) having an output shaft 175 seen in FIG. 13, and this output shaft 175 drives a timing wheel 177 through a clutch mechanism 178. The clutch 178 is a commercial product and is shown in schematic only in FIG. 13. A suitable commercial clutch is one of the DISC/CONE CLUTCHES from TOL-O-MATIC, Minneapolis, Minn. The one used in the pipe injection apparatus 20 is actuated by compressed air. When the clutch mechanism is pressurized, the clutch will drive the timer wheel 177, and when the air pressure is bled from the clutch mechanism, the timer wheel is not driven. The timer wheel 177 is provided with a recess or notch 177a in its rim as seen in FIG. 11. A spring-loaded arm 178, having a cam follower or roller 179 on one end, is spring-loaded by spring-plunger arrangement 180 so that the cam follower 178a is kept in contact with the rim of the timer wheel 177. The normal inoperative position of the timer wheel is as shown in FIG. 11 with the cam follower 178a at the deepest part of the recess or notch 177a. When pipe such as pipe 26 is being run into the well or being withdrawn therefrom, the cam follower would normally be at the deepest part of the recess or notch 177a. In this condition, the clutch 178 is not pressurized and therefore not engaged, and the shaft 175 of the gear 160 does not drive the timer mechanism. When, however, the upper or lower sensor senses a pipe coupling which is approaching the pipe injection mechanism, the clutch will become pressurized and the timer wheel 177 will begin to be driven and a cycle is initiated which will be soon described. A bushing 200 of bronze or other suitable material and attached as by threads 202 to the timing wheel 177 as seen in FIG. 13 is formed with an external annular flange 204 which retains a cam valve mount 206 mounted thereabout for limited rotational movement as shown in FIG. 11. A pair of direction control valves 210 and 212 are mounted on the cam valve mount 206 as may be more clearly seen in FIG. 10. Valves 210 and 212 are secured to valve mount 206 at flat surfaces 207 clearly seen in FIG. 11. Each direction control valve has a spring-loaded plunger 214 having on the outer end thereof a slot in which a roller 215 is mounted. Each roller 215 is pressed into contact with the surface of the timer wheel at all times. The cam 220 on the timer wheel (FIG. 11) is in the path of the rollers 215. When the clutch 178 is energized with compressed air conducted thereto by an air line (not shown) connected to the clutch 178 at port 178*a*, the cone members 178*b* which rotate all the while the pipe is being moved up or down is forced into engagement with the male cone member 178*c*. The timer wheel then begins to be rotated relative to the cam valves 210 and 212. As the timer wheel begins to turn, not only does the cam follower 79 begin to come out of the deep part of the notch or recess 177*a* in the rim of the timer wheel, but also the cam surface 220 begins to pass under the valve 210, and this cam surface will lift the roller 215 of that valve and cause it to be actuated.

When the valve 210 is actuated, it causes the upper pressure beams 71 and 72 to retract opening the upper gripping area of the drive chains to let the advancing pipe coupling pass therebetween into the non-gripping area which is between the upper and lower gripping areas. The upper gripping area will remain open so long as the cam surface 220 holds the valve 210 in its actuated position.

The cam surface 220 extends along the outer edge of timer wheel through an arc of about 150 degrees. The gear ratio of the gear box 172 which drives the timer wheel is such that when the timer wheel turns this number of degrees, the pipe coupling will have advanced from the upper sensor down to the nongripping area. When the cam surface 220 has completed its pass beneath the valve 210, the valve 210 will return to its non-actuated position as shown in FIG. 10.

About the time that valve 210 is returned to its nonactuated position, the cam surface 220 begins to contact and pass beneath the roller 215 of the valve 212 and will actuate the same. As the valve 212 is actuated, it tends to open the lower gripping area by retracting the pressure beams 74 and 75 but will not be able to do so until sufficient hydraulic pressure is built up into the actuators which are holding the upper pressure beams engaged so that they will reliably hold the pipe or drive the same. Only after the upper gripping area is made secure will the lower pressure beams be retracted to open the lower gripping area so that the pipe coupling can pass through the lower gripping area. The lower gripping area will remain open as long as the cam surface 220 is holding the valve 220 in its actuated condition. When the cam has completed its pass underneath the valve 212, its roller 215 will ride off the cam surface 220, and the valve 212 will return to its normal or non-actuated position. When this happens, the lower gripping area will close, that is, the lower pressure beams 74 and 75 will be returned to their pipe engaging position so that the pipe is again gripped and/or driven by both upper and lower gripping areas of the drive chains.

The lower sensor mechanism 102 may be exactly like the upper sensor 100 but need not have its post 126 secured to a plate such as plate 120, but will likely be secured to the floor plate 38 of the injector 20 (FIG. 1). When the pipe coupling passes through the lower sensor 102, its valve 146 is shifted which bleeds the air from the clutch 178, and the timer wheel is no longer driven. At this time, the cam follower 179 has entered the notch or recess 177*a* in the rim of the timer wheel and is at or near the deepest part thereof. As the clutch is disengaged and the timer wheel becomes free-turning, the inward load of the cam follower 178*a* causes the timer wheel to turn if necessary until the cam follower occupies the deepest portion of the notch 177*a* of the timer wheel. The timing cycle will always begin from this point.

Although the upper and lower coupling sensors 100 and 102 are exactly alike, their functions must be reversed with a change in direction of pipe movement. For instance, when running pipe into the well, the upper sensor 100 responds to arrival of a coupling by causing air to pressurize the clutch 178 to begin the timing cycle. The lower sensor responds to a coupling by causing venting of the clutch to end the timing cycle.

As will be explained more fully later, when pulling pipe from the well, a reversal of the injection mechanism automatically causes the upper and lower coupling sensors 100 and 102 to also be reversed. Now the lower sensor 102 causes the timing cycle to be initiated and the upper sensor causes the cycle to be ended. This is accomplished by hydraulic circuitry which will soon be explained.

Thus, it has been shown that the cam 220 on the timing wheel will acutate the valves 210 and 212 to hold the upper and the lower gripping areas open so long as the cam is underneath the valves and that the cam is long enough to hold the gripping areas open for sufficient time to permit the pipe coupling to pass therethrough. It has further been shown that one of the upper and lower gripping areas can be opened only so long as the other gripping area is securely engaged with the pipe. This assures that the pipe will never be released unintentionally but that it will always be gripped and kept under control by at least one of the gripping areas.

As was explained earlier, the timing wheel 177 is driven by the transmission on the pipe injector mechanism and that the ratio of the timing wheel has been geared down so that a pipe coupling will pass from the upper sensor 100 to the lower sensor 102, or slightly below, while the timer wheel 177 makes one complete revolution. The pipe coupling entering the apparatus from above will actuate the sensor 100 to initiate the timer cycle, and when the same coupling passes through and actuates the lower sensor 102, the time cycle will be completed.

Figure 14A:
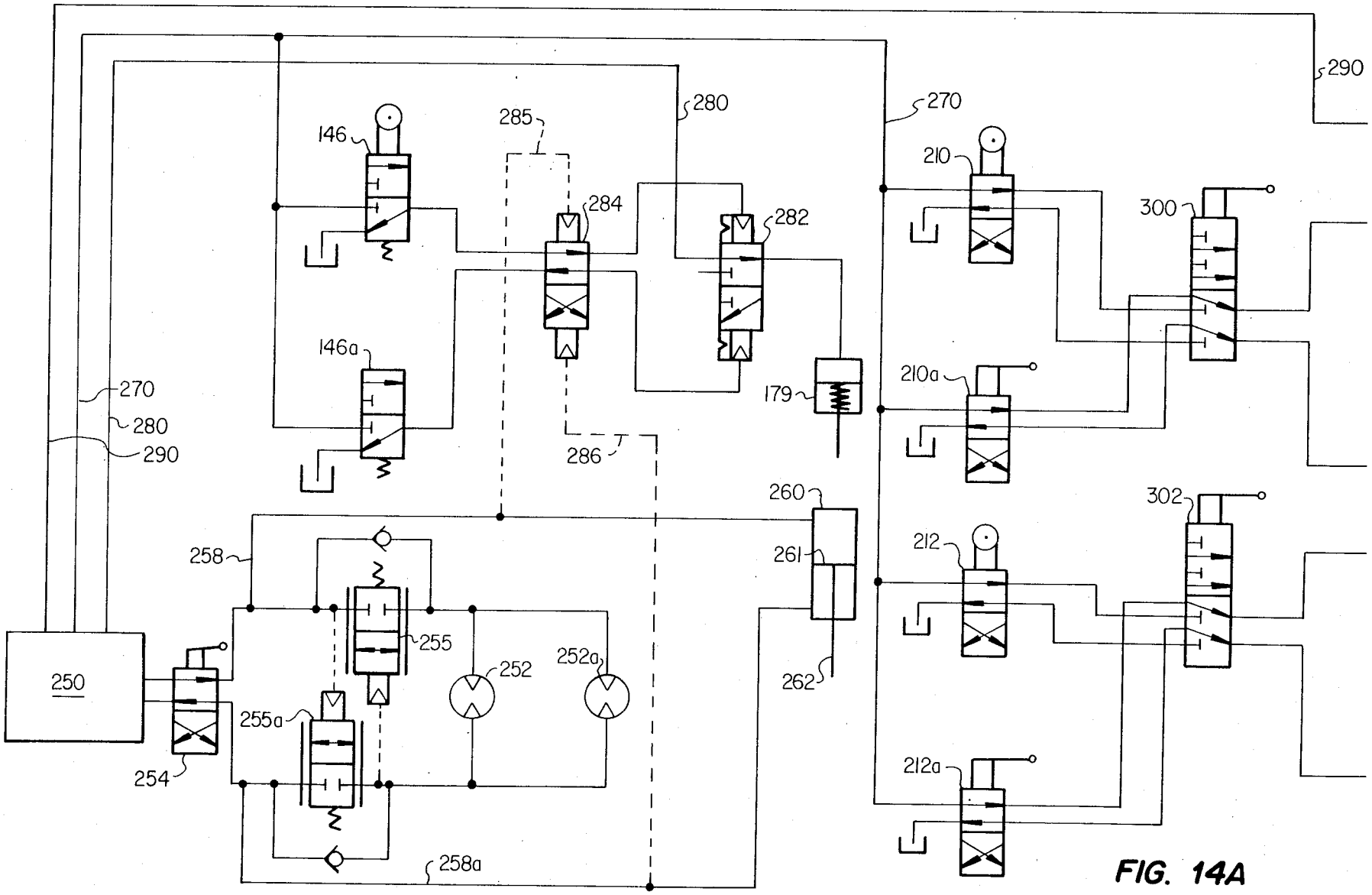
FIGS. 14A and 14B taken together constitute a diagram showing the circuitry for that part of the pipe injection apparatus pertaining to the present, invention.
Figure 14B:
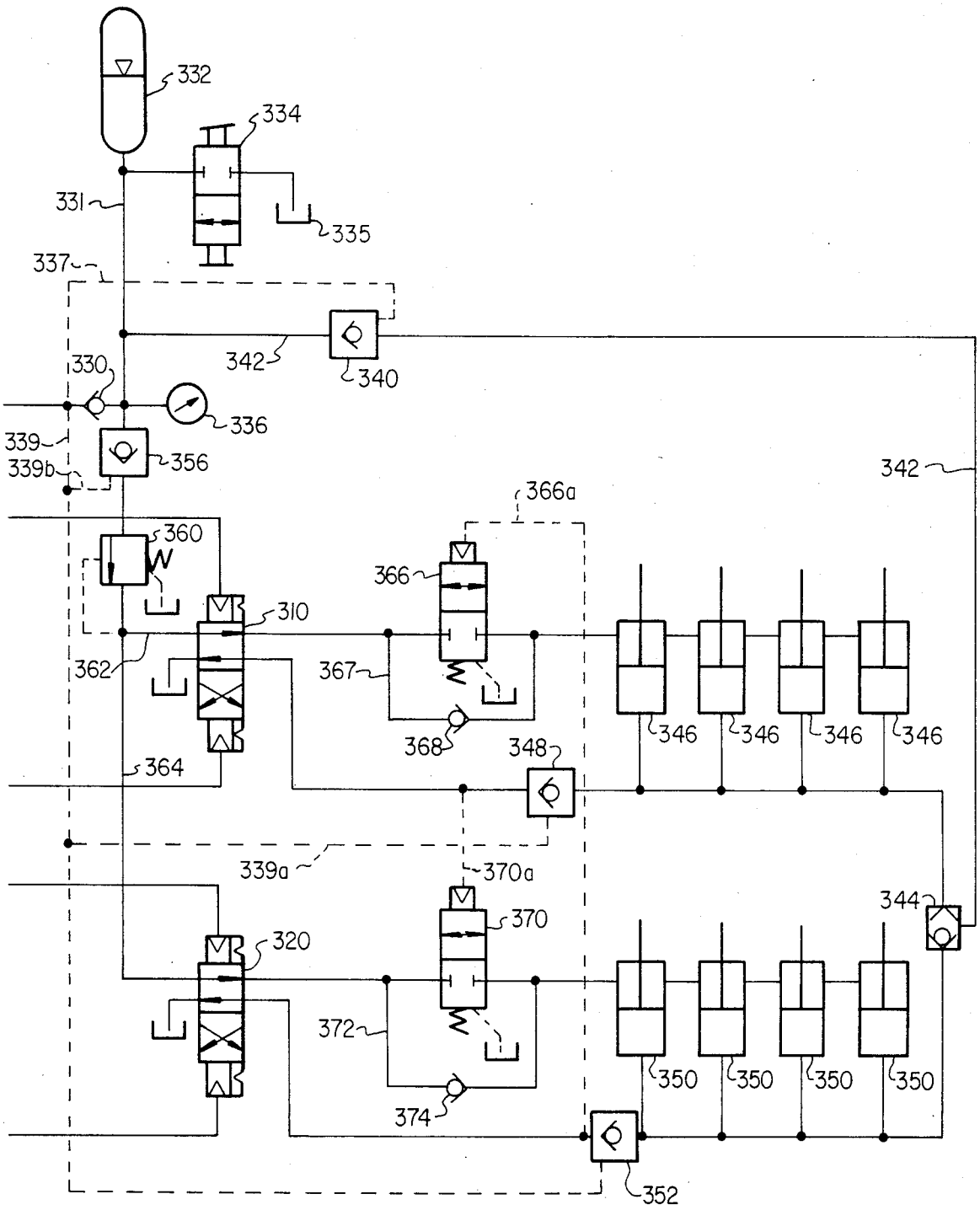

Referring now to FIGS. 14A and 14B, the hydraulic circuitry will be explained with respect to the automatic control of the pipe injector mechanism by which a pipe coupling is passable through the apparatus without being damaged or without being engaged by the driving mechanism and with respect to the interlock feature whereby a gripping area can be opened only if the other is closed.

Referring first to FIG. 14A, a power pack is represented by the reference numeral 250. This power pack will include a source of pressurized hydraulic fluid and a source of compressed air. Normally it will also include a prime mover and suitable pumps and compressors as may be necessary to furnish pressurized fluids for the operation of the entire pipe injection apparatus. The power pack will usually be near the well but not on the well. The pipe injection apparatus naturally is installed upon the well in the manner described in U.S. Pat. No. 4,515,220. All of the valves and control devices shown in FIGS. 14A and 14B will oe located on the pipe injection apparatus or upon the control console which will be mounted on or near the pipe injection apparatus. The control console (not shown) will be located at a convenient place so that the operator will have a clear view of the operation of the apparatus under his control.

All of the hydraulic valves, shown symbolically in FIGS. 14A and 14B, are commercially available items and are readily available.

The hydraulic motors 252 and **252*a* seen in FIG. 14A are supplied power fluid from the power pack 250 through the manually actuated, four-way, direction control valve 254. When the valve 254 is in the position shown, then the power fluid from the power pack 250 will flow in a clockwise direction through this valve and through the motors 250 and 252 to operate the injection apparatus to force pipe into the well. When the valve 254 is shifted to its other position, then the flow through this loop will be reversed and the injection apparatus will operate to lift or move the pipe out of the well. Counterbalance valves 255 and 255*a*** are provided in the circuit as shown to provide control should the load on the apparatus suddenly diminish or shift.

Conduit 258 is connected into the circuit just described at a point between the valve 254 and the counterbalance valve 255. The other end of this conduit 258 is connected to the cap end of a cylinder 260. This cylinder 260 contains a piston 261 having a piston rod 262 extending from the rod end of the cylinder. The piston rod 262 is connected to the timing mechanism 103 in a manner which will be described later. Another conduit **258*a* is connected between the valve 254 and the counterbalance valve 255*a*, and this conduit 258*a* has its other end connected to the cap end of the cylinder 260. It is easy to see that when the conduit 258 is pressurized, that is, when the pressure in conduit 258 is somewhat higher than that in conduit 258*a*, as when pipe is being run, the cylinder 260 will extend, and when the conduit 258*a* has the higher pressure, as when pipe is being pulled, the cylinder 260 will retract. Thus when the valve 254 is in the position shown in which position the pipe will be driven into the well, the cylinder 260 will be extended, but when the valve 254 is moved to its other position so that the injection apparatus will be moving the pipe upwardly, the cylinder 260** will be in its retracted position.

A hydraulic conduit 270 extends from the power pack 250 and has a branch conduit 271 which supplies power fluid to a pair of cam actuated, three-way, direction control valves 146 and **146*a*. The valve 146 is the valve 146 which forms a part of the upper sensor 100, and the valve 146*a* forms a like part of the lower coupling center 102. Conduit 270** carries hydraulic fluid at a pressure of aoout 800 to 1200 pounds per square inch (5516 to 8274 kilopascals).

A conduit 280 carrying compressed air at about 100 pounds per square inch (689.48 kilopascals) extends from the power pack to valve 282. Valve 282 is a three-way, two-position, direction control valve which is pilot actuated and detented in both positions. Between the cam actuated valves 146 and **146*a* and the valve 282 is a four-way direction control valve 284 which is piloted as shown. One of the pilots is connected via pilot line 285 to the conduit 258 which supplies power fluid to the cap end of cylinder 260. The other end of the valve has its pilot connected via conduit 286 to conduit 285*a* which supplies power fluid to the rod end of the cylinder 260. Thus, when the pipe injection apparatus 20 is in the mode for running pipe into the well, the valve 284 will be in the position shown because of the high pressure in conduit 250 and pilot line 285**.

When pipe is being run into the well and a coupling engages the sensor 100 at the upper end of the injection apparatus, valve 146 will be actuated from the position shown in the circuit diagram of FIG. 14A to its other position in which power fluid will pass from the conduit 271 through the valve 146 and through the valve 284 which is held open becaue the pipe is being run into the well and will be conducted to the pilot of valve 282 which will cause the valve to assume the position shown in the diagram. In this position of valve 282, compressed air supplied from the power pack through conduit 280 will pass through valve 282 and will actuate the cylinder 178 causing its piston to extend. This piston/cylinder 179 is symbolic of the disc/cone clutch incorporated into the air clutch 179 which forms a part of the timing mechanism 104. When the clutch or cylinder 179 is energized, the timer wheel 177 will begin its cycle which was previously explained. It is noted that when a coupling passes through upper sensor 101, the valve 146 is temporarily moved to its other position so that hydraulic fluid will pass through the valve and will cause valve 282 to be shifted to the position shown. Valve 282 is detented so that the valve will remain in that position even though valve 146 moves back to the position shown and the pressure in the line connecting the two will be bled through valve 146 to tank. When the coupling has passed through the injection apparatus and engages the lower sensor 102, valve **146*a* will be momentarily depressed so that pressure fluid from conduit 271 will be directed through valve 284 to the pilot of valve 282 causing it to shift back to its other position wherein the compressed air from cylinder 179 will be vented through valve 282 to the atmosphere, and as valve 146*a* returns to its normal position shown in FIG. 14A, the line from the pilot of valve 282 will be vented through valve 146*a*** to tank, as shown.

Thus when a pipe coupling arrives at the injection apparatus from above and actuates sensor 100, the cylinder 179 is energized with compressed air and the timer 104 begins its timing cycle. When that same pipe coupling passes through the lower sensor, the cylinder 179 is vented to the atmosphere and the timing cycle ends, the timing wheel having made but a single revolution. The valves 146 and **146*a*** of the sensors are left in normal position to await the arrival of the next coupling.

Hydraulic conduit 290 carries hydraulic fluid at a pressure of about 2000 pounds per square inch (13,790 kilopascals) and extends from the power pack 250 in FIG. 14A into FIG. 14B as shown. Conduit 270 extends beyond its point of connection with conduit 271 in FIG.

14A into FIG. 14B as shown. If necessary or if desired, conduit 270 could be branched from conduit 290 provided a pressure reducing valve would be used to reduce the pressure to about 800 to 1200 pounds per square inch. This practice, however, is not recommended. It is much better practice to have nothing demanding or robbing pressurized fluid from the circuit which supplies the pipe gripping means. Preferably, conduits 270 and 290 extend separately from the power pack. In this manner, conduit 290 as will be seen is used to supply pressurized hydraulic fluid to the pressure beam cylinders. It is a dead-end circuit, and no other devices draw energy from this circuit. Conduit 290 as seen in FIG. 14B is used to control the operation of the pressure beams, etc.

Referring now to FIG. 14B, it will be seen that the conduit 270 supplies hydraulic fluid to four valves 210, 210*a*, 212 and 212*a*. Valves 210 and 212 are cam-operated, two-position, four-way, direction control valves, and these are the two valves that are on the timer mechanism. Valve 210*a* and valve 212*a* are manually controlled counterparts to valves 210 and 212 just mentioned. Normally valves 210 and 212 control the opening of the gripping areas of the drive chains in an automatic manner being responsive to the cam on the timer wheel. Valve 210 can be used to manually control the opening and closing of the upper gripping area, and likewise valve 212*a* can be used to manually control the opening and closing of the lower gripping area as desired.

Valve 210 when in the position shown supplies power fluid to valve 300, and valve 210*a* when in the position shown also supplies power fluid to valve 300, but the two valves 210 and 210*a* cannot supply power fluid through valve 300 at the same time. Normally valve 210*a* would remain in its other position while pipe is being run automatically. Likewise, valve 212 when in the position shown supplies power fluid to valve 302, and valve 212*a* when in the position shown also supplies power fluid to valve 302, but the two valves 212 and 212*a* cannot supply power fluid through valve 302 at the same time.

Valve 300 is a manually-operated four-position, four-way valve used to transfer the function from valve 210 to valve 210*a* or back again, as desired. When valve 300 is in the position shown, it cannot communicate with valve 210 but communicates with valve 210*a*, so valve 210*a* is the controlling valve. Valve 210*a* can be used at this time to perform the same function that valve 210 would normally perform, that of opening and closing the upper pressure beams. When valve 300 is moved to its normal position, it would communicate with valve 210 and provide automatic control of the upper pressure beams. In a similar manner, valve 302 is supplied fluid by valve 212 or valve 212*a*. Valve 302 is exactly like valve 300 and is used to transfer control from valve 212 to 212*a* and back.

When the cam on the timer wheel 177 actuates valve 210 to the position shown in FIG. 14A, power fluid will pass from conduit 270 through valve 210 and through valve 300 to the pilot on valve 310 causing it to shift to the position shown. Valve 310 is a two-position, four-way, pilot-operated direction control valve which is detented in both positions. Thus when valve 300 has been shifted to the position shown, it will remain in that position due to the detent. At the same time that the valve 210 is shifted to the position shown, pilot pressure can bleed from the other pilot of valve 310 back through valve 300 and through valve 210 to tank.

In similar manner, power fluid from the conduit 270 is supplied to valve 302 through valve 212 or 212*a* depending on whether manual or automatic operation is the mode and the power fluid passes through valve 302 to the pilot of valve 320 causing the valve to shift to the position shown in FIG. 14B. Since valve 320 is exactly like valve 310 and therefore detented in both positions, it will remain in the position shown until it is purposely moved to the other position. Valve 212 is a cam-operated valve and is operated by the cam on the timer wheel 177, and this valve 212 rather than valve 212*a* is in control during normal automatic operation. Thus, when valve 212 is actuated by the cam on the timing wheel, power fluid is admitted therethrough and through valve 302 to the pilot on valve 320 shifting it to the position shown. At the same time, power fluid from the pilot on the other end of valve 320 will flow back through valve 302 and valve 212*a* to the tank. When the cam 220 on timer wheel 177 has completed its pass by valve 212, valve 212 will return to its other position, due to its spring, and the flow therethrough will be reversed so that the pressure will be bled from the pilot of valve 320. In the same manner, when the cam 220 on timer wheel 177 has completed its pass by valve 210, the same thing happens—pressure will be shifted to the other pilot of valve 310 causing valve 310 to be shifted to its other position.

Valves 310 and 320 are direction control valves which are used to control the opening and closing of the upper and lower gripping areas of the drive chain by actuating the upper and lower pressure beams between pipe engaging and pipe releasing positions. These operations are accomplished in a manner which will now be described.

Power fluid delivered through conduit 290 passes through check valve 330 and is directed into the accumulator 332 to charge the same. At this time, of course, the bleeder valve 334 is closed to prevent the escape of power fluid into the tank 335. Pressure gauge 336 indicates the pressure of the charge in accumulator 332. As pressure is built up in the accumulator 332, it is also built up in certain portions of the circuitry. It will be noticed that pilot lines 337 and 339 branch off of the conduit 290 just ahead of the check valve 330. Therefore, as the accumulator is being pressurized, so are these pilot lines. Pilot line 337 is connected to a check valve 340 in branch conduit 342. Check valve 340 is pilot-operated to close and will remain so long as pressure exists in pilot 337 and cannot be opened by pressure in conduit 342 acting on either side thereof. Thus, conduit 342 will be pressurized fully only to check valve 340.

Check valve 330 prevents the accumulator from discharging back through the conduit 290 which would otherwise happen should conduit 290 suffer a rupture or otherwise be bled off.

When check valve 356 opens, pressurized fluid is admitted into the circuitry therebeyond. Pressurized fluid will thus pass through pressure reducing valve 360 which is now open and will be conducted through conduits 362 and 364 to the valves 310 and 320. When pressure beyond valve 360 builds sufficiently, it will begin to reduce the hydraulic fluid pressure from about 2000 pounds per square inch to about 1200 pounds per square inch. Thus, the pressure beam actuating cylinders 346 and 356 will operate at 1200 pounds per square inch and the 2000 pounds per square inch in the accumulator will provide considerable reserve fluid pressure to maintain a grip on the pipe for an appreciable period should conduit 290 lose pressure despite the fact that some small leakage may develop in the circuitry. When the valve 310 is in the position shown, pressurized fluid is conducted therethrough to valve 366 which is shown in its normal position. But since the circuitry is now pressurized, pilot line 366*a* will be pressurized also and valve 366 will be in its other position. In this position, fluid will flow through valve 366, to the rod end of the upper pressure beam actuating cylinders 346 to cause them to retract and open the upper gripping area. Then, when valve 310 is shifted to its other position, the pressure is bled from the rod end of the upper pressure beam actuating cylinders and through valves 366 and 310 to tank. When the valve 310 is in such position, the upper pressure beam cylinders have their rod ends bleeding to tank through valve 310, pressurized fluid is conducted through valve 310 to the cap end of the cylinders 346 causing them to extend to pipe gripping position.

In similiar manner, when the valve 320 is in the position shown, pressurized fluid may pass from conduit 364 therethrough to valve 370 but when this valve 370 is in the position shown, pressurized fluid cannot pass therethrough and neither can it pass through its bypass 372 because of its check valve 374. However when the valve 370 is in its other position as due to sufficient pressure on its pilot then pressurized fluid will be conducted therethrough to the rod ends of the lower pressure beams actuating cylinders 350 causing them to retract to pipe releasing position. At the same time, the cap ends of the cylinders 350 are allowed to bleed to tank through valves 370 and 320. When valve 320 is shifted to its other position, the flow of pressurized fluid therethrough is reversed so that the rod ends of the cylinders 350 are allowed to bleed through valves 370 and 320 to tank while pressurized fluid is conducted through valves 320 and 370 to the cap ends of the cylinders 350 causing them to extend to pipe gripping position.

It will be noticed that the valve 366 is pilot operated and that its pilot line 366*a* is connected into the conduit which supplies fluid pressure to the cap ends of the lower pressure beam actuating cylinders 350. Thus, when the cylinders 350 are extended to pipe gripping position to support the pipe in the injection apparatus, the pilot line pressure in conduit 366*a* is sufficient to maintain the valve 366 actuated so that fluid pressure can be supplied to the rod ends of the upper actuating cylinders 346 to cause them to retract. It is important that the upper actuating cylinders can be retracted only if the lower actuating cylinders are extended to pipe gripping position and that they are held in this position by sufficient pressure to cause the valve 366 to be shifted by pressure in the pilot line 366*a*. Valve 366 has a very strong return spring and requires high pilot pressure for its actuation. In similiar manner, it will be noticed that the valve 370 which supplies fluid pressure to the lower pressure cylinders causing them to retract to pipe releasing position is piloted by fluid pressure arriving through pilot line 370*a* from the conduit which supplies fluid pressure to the upper actuating cylinders causing them to extend. Valve 370 also has a strong return spring and can only be actuated to retract the lower actuating cylinders when the upper actuating cylinders are in pipe gripping position and the pressure holding them in this position is sufficient to hold the load of the pipe. Then, and only then, will the pressure in pilot line 370*a* be sufficient to shift the valve 370 to its other position.

Thus it is seen that the interlock mechanism provided by the cross piloting of the valves 366 and 370 is such that one of the upper or lower gripping areas can be opened only if the other of the gripping areas is closed. That is, the upper pressure beams cannot be retracted to release the pipe unless the lower pressure beams are holding the pipe, and vice versa. It is extremely important that one of the gripping areas grip the pipe at all times to support it against blowout or against falling into the well, and also to drive it either into or out of the well.

As was stated earlier, the check valve 340 which is piloted closed remains closed so long as the pressure in pilot line 337 and therefore in conduit 290 remains at a sufficiently high level. Should, however, the conduit 290 become ruptured or pressure should otherwise be lost, check valve 330 would close immediately, but pilot lines 337, 339, 339*a* and 339*b* would lose pressure along with conduit 290. Loss of this pilot pressure would cause check valves 348, 352 and 356 to close and check valve 340 to open. Check vlves 348, 352, and 356 are needed because valves 366 and 370 do not shut off tightly and would, in time, bleed the accumulator 332 down and cause the grip on the pipe to fail. Check valves 348, 352, and 356 shut off tightly and prevent such loss of accumulator pressure. With check valve 340 now open, pressure in the accumulator is transmitted through the conduits 331 and 342 to the shuttle valve 344. The shuttle valve 344 directs this fluid pressure to either the upper or the lower pressure beam actuating cylinders 346 or 350, or both, whichever is in pipe gripping position. In the position of the check valve 344 as shown in the drawing, pressure from the accumulator arriving through conduit 342 at the shuttle valve would be directed through the shuttle valve to the upper pressure beam actuating cylinders 346 and will hold them in the pipe gripping position. Thus the pressure in the accumulator will be applied to the pressure beam actuating cylinders to maintain a secure grip on the pipe.

The hydraulic circuitry shown in FIGS. 14A and 14B have thus far been described with the pipe injection apparatus in the running in mode, that is, the pipe handled thereby has been moved into the well. To reverse the direction of the pipe so that the pipe will be moved out of the well, the valve 254 will be moved manually to the other of its two positions so that the flow therethrough will be reversed. In this position of the valve, the power fluid from the power pack 255 will proceed through the valve 254 and will be directed through valve 255*a* to the motors 252 and 252*a* to turn them in the opposite direction from which they were turning when the pipe was being moved into the well. The spent power fluid from the motors will flow through valve 255 back to the valve 254 and from there on to the power pack where it will be deposited in the tank (not shown). With the hydraulic motors 252 and 252*a* now running in the reverse direction, the pressure in conduit 258*a* will be higher than the pressure in conduit 258. Conduits 258*a* and 258 are connected to the cylinder 260 which is mounted on the timer 104. Since the pressure in 258*a* is now greater than the pressure in 258, the piston in the cylinder 260 will be retracted for a purpose which will now be explained.

Please refer to FIG. 11 where it is seen that the cylinder 260 has its piston rod 262 connected as by pin or bolt 262*a* to the outer end of level 206*a* mounted on the cam valve mount 206. The cam valve mount 206 as before explained is mounted rotatably about the bronze bushing 200. The cam valves 210 and 212 are mounted on flat surfaces formed on the cam valve mount 206 so that the rollers on the plungers of the cam valves roll on the surface of the timer wheel 177. The timer wheel is provided with a raised cam 220 which extends for about 150 degrees along the rim edge of the wheel. When this cam engages one of the rollers, it cams it upwardly to depress the plunger and actuate the cam valve. When the cam has finished passing the cam valve, the roller of the cam valve rolls off of the cam, and the valve is returned to its unactuated condition. When the pipe is being run into the well, the relation between the cam valves and the timer wheel is as shown in FIG. 11. In this position, the piston rod 262 of the cylinder 260 is in the position shown. When the direction of the hydraulic motors 252 and 252*a* are reversed in order to reverse the direction of pipe movement, the cylinder 260 is actuated to retract the piston 262 thereof, thus applying a force to the lever 206*a* on the cam valve mount 206 and causing the cam valve mount to rotate in a counter-clockwise direction, as seen in FIG. 11, to a distance of about 60 degrees. Also, the reversal of the motors 252 and 252*a* causes a reversal in the direction in which the timer wheel 107 is rotated. In FIG. 11, the timer wheel is rotated in a counter-clockwise direction because in the mode shown with the piston rod 262 of cylinder 260 extended, the pipe is being driven into the well. When the direction of pipe movement is reversed as by actuating valve 254, the direction of rotation for the timer wheel 177 will also be reversed and will now be rotating in a clockwise direction as seen in FIG. 11. With the direction of pipe movement reversed and with the cylinder 260 having its piston rod 262 retracted, the cam valves 210 and 212 are displaced from the position shown in FIG. 11 to a position about 60 degrees counter-clockwise therefrom. The roller of the valve 212 would be very close to the end of the cam 220 on the timer wheel. In this position, as soon as the timer wheel begins its clockwise rotation, the cam will soon thereafter actuate the valve 212. The valve 212 when actuated causes the lower pressure beam actuating cylinders to retract and stay retracted as long as the cam 220 holds the valve 212 actuated as before explained. When the cam 220 has finished passing beneath the valve 212, its leading end begins to actuate the valve 210. Valve 212 will return to its unactuated position about the time that valve 210 becomes actuated. When valve 212 returns to its unactuated position, it causes the lower pressure beam actuating cylinders to extend so that the pipe will be gripped in the lower gripping area. When valve 210 is actuated, then it causes the upper pressure beam actuating cylinders to retract, but they cannot retract until the pressure in the lower actuating cylinders is sufficiently high to cause the valve 366 to be actuated by sufficient pressure in the pilot line 366*a* as before explained. In this manner, the upper gripping area cannot be released until the lower gripping area takes over with sufficient force to carry the load, that is, to grip the pipe sufficiently to prevent the pipe from blowing out or falling.

The shifting of the cam operated valves 210 and 212 in the timing mechanism by actuating the cylinder 260 is necessary in order to properly coordinate the movement of a pipe coupling through the pipe injection apparatus for the following reason.

The non-gripping area 85 in the pipe injection apparatus is preferably of adequate length. In the apparatus constructed in accordance with this invention, a non-gripping area 85 of about 48 inches is provided. When pipe is being run into the well, the upper gripping area is opened to allow a coupling to pass through, and then as soon as that coupling reaches the non-gripping area, the upper gripping area may be closed again after which the lower gripping area can be opened up to allow the coupling to pass therethrough. Since it takes time for the gripping areas to close and pressure to build up and the other gripping area to open all the while the coupling is traveling, the gripping area is necessarily about 40 inches (101.6 centimeters) long. When pipe is being removed from the well and a coupling approaches the pipe injection apparatus, the lower gripping area must be open to allow the coupling to pass therethrough into the non-gripping area, but as soon as the pipe coupling reaches this non-gripping area, the lower gripping area must be closed and the upper gripping area open to allow the coupling to pass therethrough. Again, it takes time for the lower gripping area to close and for pressure to build up and then for the upper gripping area to open before the coupling reaches that point. Again, the non-gripping area must be about 48 inches long in order to allow a coupling to pass through the pipe injection apparatus safely without having to be stopped to await the action of the opening and closing of the gripping areas. Of course, it is understood that with a sufficiently long gripping area, the coupling could be moved to the center of the non-gripping area before the gripping area through which it had just passed was caused to close and before the next gripping area would be caused to open. Should this be the case, the gripping area would have to be approximately 96 inches long. Thus, in order to minimize the length/height of the pipe injection apparatus, the cylinder 260 is used to shift the valves 210 and 212 through a displacement of about 60 degrees from one mode to the other. In their position shown in FIG. 11, the valves 210 and 212 are positioned for running pipe into the well, and when they are shifted counter-clockwise about 60 degrees, they are in position for pipe to be pulled from the well. Of course, it should be remembered that when the hydraulic motors 252 and 252*a* are reversed and the pressure in conduit 258*a* becomes greater than the pressure in conduit 258, the valve 284 will be shifted to its other position due to the pressure in pilot line 286 exceeding that in pilot line 285. Thus, the flow of fluids through valve 284 is reversed, and this causes a reversal of the upper and lower sensors so that these sensors have a reverse effect on the air cylinder 179 of the timer. Under these conditions, the valve 146 of the upper sensor would cause the air cylinder 179 not to be energized but to be bled off, and, similarly, the valve 146*a* of the lower sensor would not cause the air cylinder 179 of the timer to be bled off but would cause it to be pressurized.

Thus, it has been shown that the control circuitry of FIGS. 14A and 14B controls the pipe injection apparatus and that it can control the movement of the pipe therethrough in such manner that pipe can be run into the well or be pulled from the well so that the couplings in the pipe string can be passed through the drive mechanism of the injection apparatus without being gripped thereby and without necessarily stopping the pipe in order to move the couplings therethrough.

The pipe injection apparatus 20, as was before explained, is usable with a quill such as that described in U.S. Pat. No. 4,515,220 which has been incorporated herein by reference. The quill 400 seen in FIGS. 15A and 15B serves the same purpose as the quill 75 disclosed in U.S. Pat. No. 4,515,220. This quill permits the pipe injection apparatus 20 to both drive the pipe longitudinally and rotationally, either independently or simultaneously. The quill 400 has a body 404 to the upper end of which is mounted a rotating mechanism 406 through use of a union 408. On the upper end of the rotating mechanism 406 is a gripper mechanism 410 attached through use of a union 412 which may be exactly like the union 408. Gripper mechanism 410 may be exactly like that disclosed in Sizer, supra U.S. Pat. No. 3,215,203. The quill 400 need not be greater in length than the quill shown in U.S. Pat. No. 4,515,220 although the injection apparatus is appreciably taller, since the quill will be controlled manually using valve 210*a* to actuate the upper gripping area while the lower gripping area is locked open by manual valve 212*a*.

Figure 17:
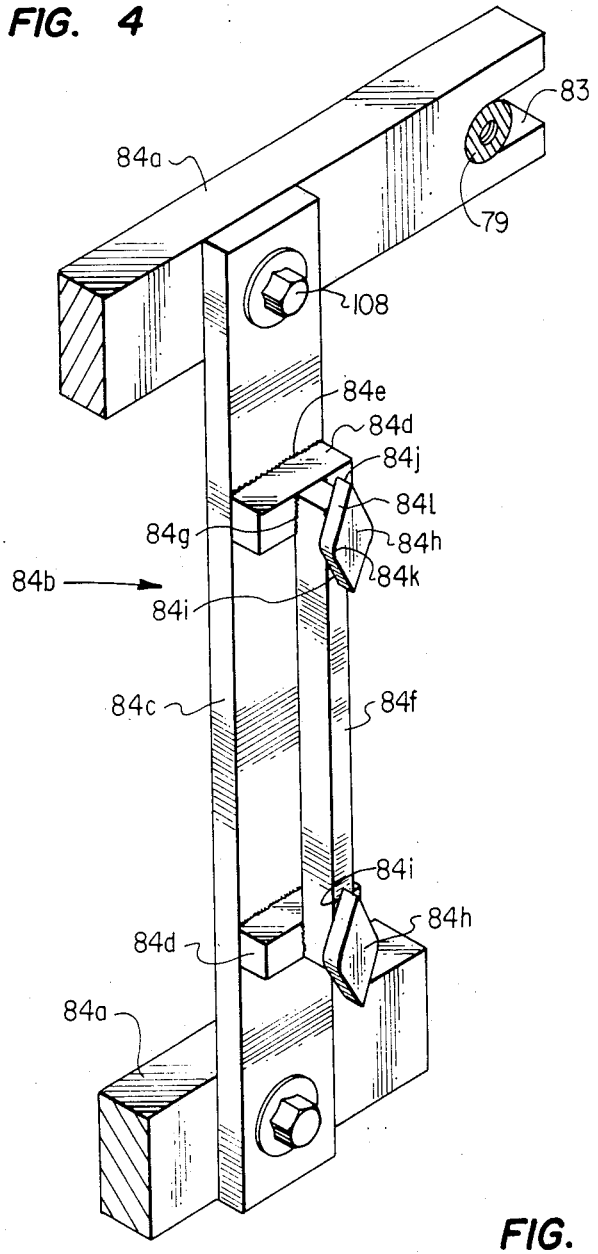
FIG. 17 is a schematical oblique view showing an accessory for spreading the drive chains apart in the nongripping area.
Figure 15A:
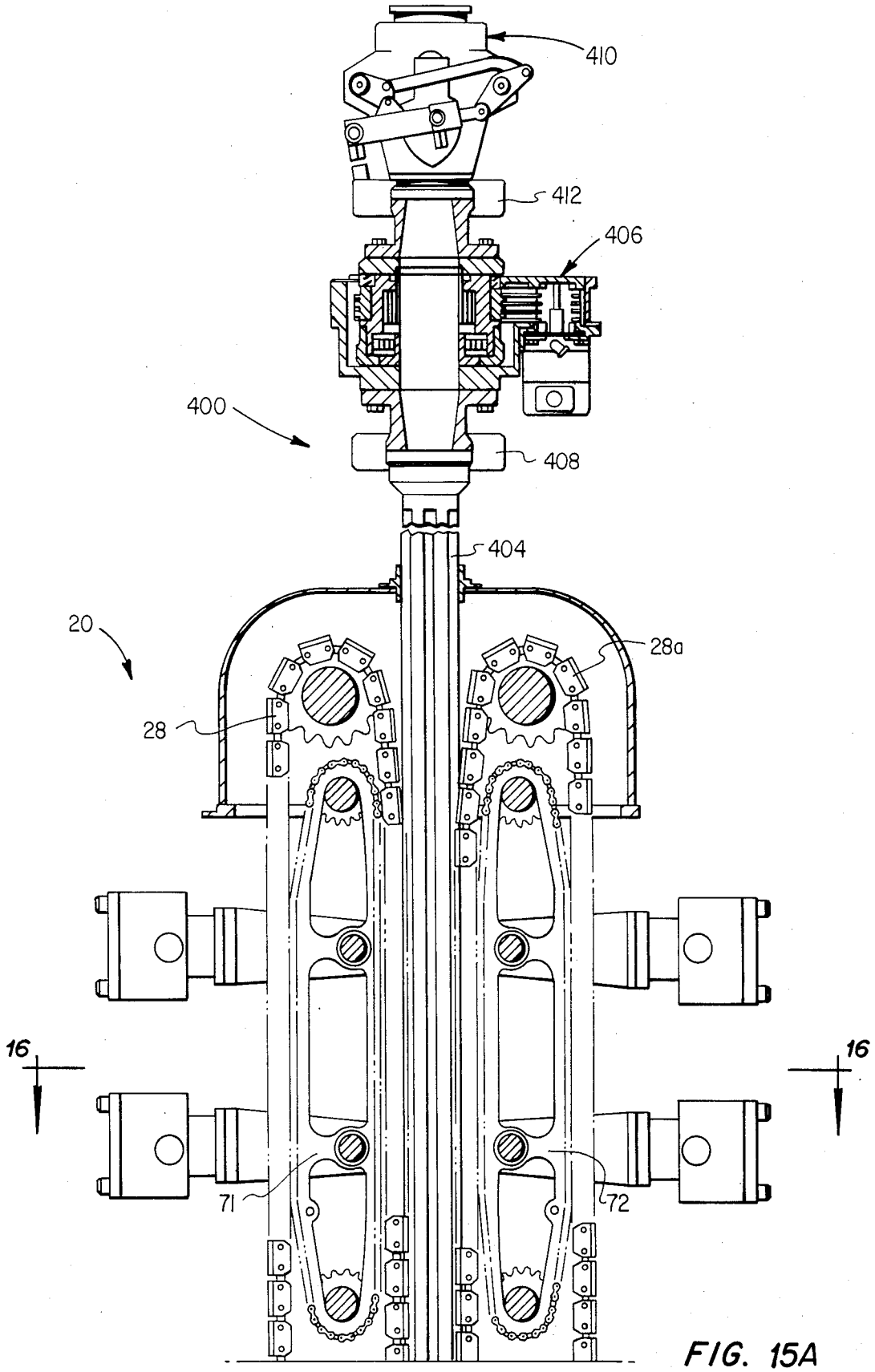
FIGS. 15A and 15B taken together constitute a longitudinal sectional view similar to FIGS. 2, 5, and 6 showing the pipe injection apparatus with a quill engaged in the upper and lower gripping areas, the quill having a gripping and rotating mechanism mounted on its upper end.
Figure 15B:
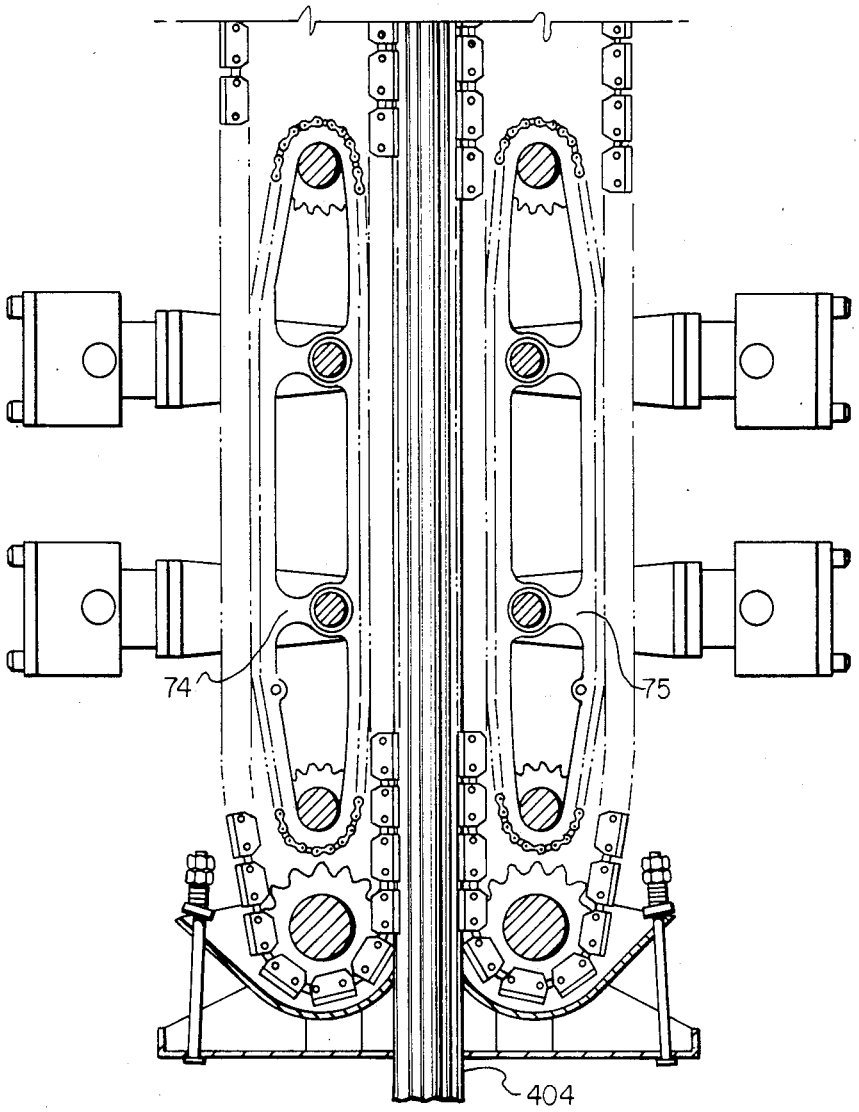
Figure 16:
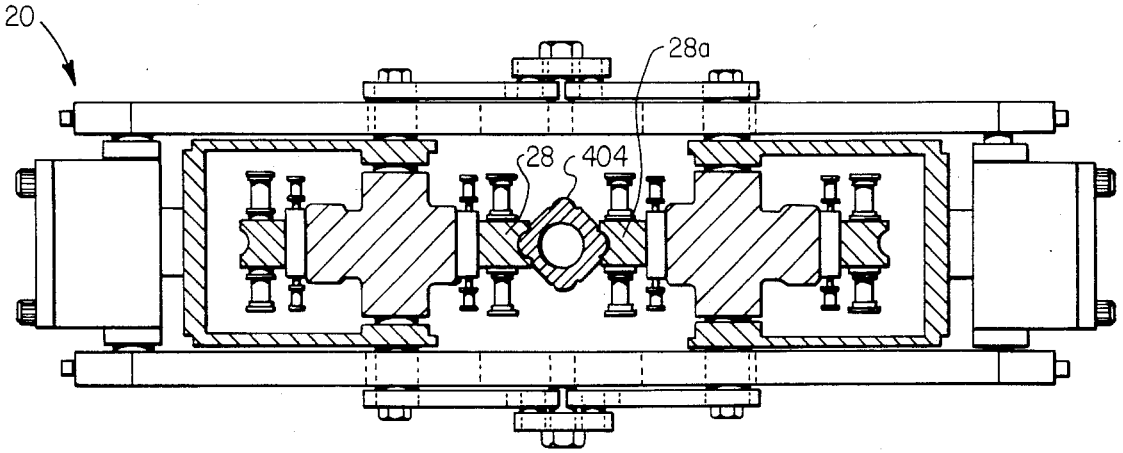
FIG. 16 is a cross-sectional view taken along line 6—16 of FIG. 15A.

FIG. 16 is a transverse sectional view taken through FIG. 15A and is similar to that shown in FIG. 3. However, in FIG. 16, it is seen that the body 404 of quill 400 is being held in the grip between the drive chains 28 and 28*a* which are held in pipe gripping position by upper pressure beams 71 and 72. It is noticed that the body 404 of the quill 400 is generally square in cross-section but that each corner is contoured in semicircular fashion to present to the drive chains a shape which is like that of the pipe and of the same radius. Thus, the drive chains 28 and 28*a* grip the quill in the same manner that they would grip the pipe. It is readily seen that the body 404 of the quill is somewhat greater in thickness or diameter than is the pipe. As was stated earlier in this application, the pipe injection apparatus 20 is capable of retracting its drive chains until each has moved away from center by a full 4 inches (10.16 centimeters). This 4-inch movement, of course, is accomplished by first removing the stop blocks, such as the stop block 82*a* seen in FIG. 4, so that the trunnions may retract fully in the slots, such as slot 82, formed in the side plates. When such stop blocks are removed, the pressure beams can be retracted a full 4 inches, thus providing sufficient space between the drive chains to insert the quill 400. The pressure beams are then extended so that the drive chains are pressed against the rounded corners of the quill body 404 as seen in FIG. 17, and the drive chains then will grip the quill body and will be able to drive the quill up or down.

When the quill 400 is used with pipe, the pipe of course extends through the central bore of the quill and also through the drive mechanism 406 and through the gripper mechanism 410. The gripper mechanism 410 is actuated hydraulically and can be moved from pipe gripping position to pipe releasing position. When the pipe is held by the gripper which is in the pipe gripping position, the pipe of course cannot move up or down relative to the quill. However, the quill can be moved up and down in order to move the pipe up and down. The rotating mechanism 406 is also actuated by hydraulic fluid pressure, and the upper portion of it is swivelly connected to the lower portion. When the pipe rotating mechanism is actuated, the rotating mechanism will rotate the pipe gripping mechanism mounted on the top thereof so that the pipe will be rotated through the quill. The pipe rotating mechanism is operated independent of the pipe injection apparatus so that the pipe can be rotated while it is being moved up or down or while it is standing still. The quill is used generally in order to rotate the pipe in order to remove obstructions in the well flow conductor such as sand bridges, or the like. During such operation, the pipe is generally rotated while it is slowly lowered in the well in order to drill or otherwise remove such obstructions.

It is understandable that the coupling sensors 100 and 102 are too small to accept the quill body 404 in the place of the pipe 26. Therefore, before the quill is inserted in the apparatus, the coupling sensors must be disengaged from the pipe and pivoted to an out-of-the-way position. Then, after using the quill, it is removed from the apparatus, and the sensors are restored to service by swinging them into position and engaging them with the pipe.

Thus it has been shown that the pipe injection apparatus 20 is provided with upper and lower opposed pairs of pressure beams which are placed within a pair of endless drive chains; that the opposed pressure beams can be actuated toward and away from the centerline of the apparatus so that the pipe between the pressure beams or between the drive chains can be gripped thereby; that the upper and lower beams are spaced apart to provide a non-gripping area between the upper and lower gripping areas; that a pipe coupling can be passed through the pipe injection apparatus without being gripped in either of the gripping areas; that the movement of the pipe is coordinated with the pipe injection apparatus so that the coupling will be sensed as it approaches the apparatus; that the upper or lower gripping area, whichever comes first, will be opened to allow the coupling to pass through; and that when the coupling reaches the non-gripping area between the upper and lower gripping areas the gripping area through which the pipe coupling has just passed will close and the other gripping area will subsequently open to allow the coupling to go through without having to necessarily stop movement of the pipe. It has been shown that the pipe injection apparatus is provided with control circuitry and apparatus for opening and closing of the upper and lower gripping areas in a coordinated manner so that a pipe coupling approaching the apparatus from either direction will be allowed to move through the apparatus without being gripped by either of the two gripping areas and without necessarily stopping movement of the pipe in the process. It has further been shown that the apparatus is provided with interlock mechanism which prevents one of the gripping areas from being opened until the other gripping area is assuredly closed, that is, one of the gripping areas can be opened only if the other gripping area is closed.

Further, it has been shown that the pipe injection apparatus is provided with a linkage mechanism linking together the opposed beams so that the beams will move equidistant from centerline in their travel to and from pipe gripping position. Thus, the beams are always equidistant from the centerline. In this manner, when the pipe gripping areas are open, the opening between the drive chains will be centered in the mechanism which assures that the pathway for the pipe will be straight. It has further been shown that the pipe injection apparatus is provided with circuitry which provides considerable safety. For instance, there is a check valve and shuttle valve in the circuitry which, should the high pressure conduit 290 from the power pack to the circuit break, or rupture, or should the pressure suddenly fall, one check valve would close to prevent further escape of fluid, the piloted closed check valve would open and would allow pressure directly from the accumulator to be applied to that gripping area which is gripping the pipe at the time to assure that this grip will be maintained as long as adequate pressure remains in the accumulator.

Further, it has been explained that the hydraulic circuitry also contains apparatus connected therein which will automatically cause a reversal of the coupling sensing functions when pipe direction is reversed. Thus, the pipe can be run into the well or pulled therefrom, and when the apparatus is changed from the running mode to the pulling mode, or vice versa, the coupling sensing mechanism is, accordingly, automatically switched from one mode to the other so that a coupling approaching the apparatus from either direction will be conducted through the apparatus as before explained.

There is a possibility that the drive chains 28 and 28*a* when under considerable load may cause minor damage to pipe couplings as they pass through the non-gripping area 85. This would be because the chains are spread apart slightly by the coupling a distance of almost one-fourth inch (6.35 millimeters) on each side of center. Couplings which are properly chamfered on each end are not likely to be damaged this way. To avoid the possibility of such minor damage, means for spreading apart the drive chains while in the non-gripping area may be readily provided and attached to the apparatus 20. Such means could be in any suitable form. One form of spreading means is illustrated in FIG. 17.

In FIG. 17, it is seen that the spreading means is indicated generally by the reference numeral 84*b*. The spreading means 84*b* includes a vertical base member 84*c* which has its opposite ends secured to the inner side of the side plates such as the side plates 84*a* (FIG. 1) which are immediately above and below the non-gripping area 85 (FIG. 2). Base member 84*c* may be secured in place with bolt 108 on which the bell crank 106 is pivotally mounted on the outer side of the side plates as before explained. Alternatively, the base member could be mounted by any other suitable means. Upper and lower cleats 84*d* are secured in spaced apart relation to the vertical base member 84*c* by suitable means, such as welding as at 84*e*, as shown, or by bolting (not shown). A spacer member 84*f* has its opposite ends secured as by welding at 84*g* to the cleats, as shown. A spreader member 84*h* is secured at the upper and lower ends of spacer member 84*f*. These spreader members are spaced apart sufficiently to spread the drive chains substantially the full length of the nongripping area. Each spreader member 84*h* has its upper and lower ends shaped to resemble a boat which is pointed at both ends. Each spreader member is secured to spacer member 84*f* by suitable means such as by welding as at 84*i*, or by bolting (not shown). Each spreader member has a wedge shaped end, such as end 84*j* which spreads the drive chains, and its sides 84*k* are curved suitably to permit the links of the opposed drive chains to slide smoothly along the guide surfaces 84*l*. The spreader members 84*h* are placed between the opposed drive chains so that the bearings 29 (FIG. 3) on the outer ends of the chain links (which engage the teeth of the sprockets, such as sprockets 50, 51, 54, and 55) will be engaged by the guide surfaces 84*l* on spreader members 84*h* and thus cam the drive chains apart in the non-gripping area 85 by a distance which will clear the pipe couplings as they pass through the area and thus prevent any possibility of damaging the pipe couplings.

One spreader means such as spreader means 84*b* would be attached on the front side plates of the pipe injection apparatus, as seen in FIG. 1, and another would be attached to the side plates on the back side of the apparatus. For clarity, such spreader means is not shown in FIG. 1.

Obviously the spreader members 84*h* could, if desired, be configured differently. For instance, each could be constructed from a pair of arcs, such as two portions of a hoop.

Also, the spreader members 84*h* could be mounted on the upright members 40*a* and 40*b* of the frame means 40, if desired, using suitable adapter members. Rollers could be incorporated into the spreader members to reduce friction, if desired.

Thus, the pipe injection apparatus illustrated and described in this application fulfills all of the objects set forth early in this application. It is understood, however, that variations in the sizes and arrangement of parts and changes in materials may be had without departing from the true spirit of this invention.

I claim:

1. Apparatus for injecting pipe or tubing into a well or withdrawing it therefrom, comprising:

a. frame means; and b. endless-type chain drive means mounted in said frame means for gripping and moving said pipe or tubing into or out of the well, said chain drive means including:

i. drive chain means including a pair of opposed endless drive chains disposed in a common plane and spaced apart providing a pathway for said pipe or tubing therebetween, ii. upper and lower pressure beam means in each of said pair of endless drive chains movable toward and away from each other, said upper beam means being spaced above said lower beam means to provide a non-gripping area therebetween, said pressure beams having outwardly extending trunnion means slidably disposed in slots in side plates of said frame means, iii. friction-reducing roller chain means interposed between said pressure beam means and said drive chain means, iv. means for independently moving said upper and said lower pressure beam means toward and away from each other to cause said drive chain means to grip said pipe or tubing at upper and lower spaced apart locations and to release such grip at such spaced apart locations, and v. means for driving said drive chain means to move said pipe or tubing into or out of said well.

2. The apparatus of claim 1, wherein said chain drive means and said pressure beam moving means are operated by means powered by pressurized hydraulic fluid.

3. The apparatus of claim 2, wherein said pressure beam means include linkage means linking together opposed pressure beams and causing them at all times to be positioned equidistant from the center of said pathway.

4. The apparatus of claim 3, wherein said means for moving said upper and lower pressure beams includes interlock means operable to permit actuation of one of said upper and lower pressure beam means to release position only when the other of said upper and lower pressure beam means is in gripping position.

5. The apparatus of claim 4, wherein said interlock means includes means for sensing pipe couplings, or other enlargements, approaching the drive chain means and actuating said interlock means in response thereto.

6. The apparatus of claim 3, wherein said means for moving said pressure beams includes interlock means including:

a. timer means drivable by said drive chain driving means for controlling said moving means;
b. clutch means releasably engaging said timer means and said drive chain driving means;
c. first sensor means at a first end of said apparatus for engaging said clutch means to start said timer means in response to arrival of a pipe coupling or other enlargement at said first sensor means;
d. said timer means controlling actuation of said moving means causing said upper pressure beams to retract to allow said pipe coupling to move freely through said upper gripping area and afterwards causing said upper pressure beams to return to pipe gripping position and causing subsequent retraction of said lower pressure beams to allow said pipe coupling to move freely through said lower gripping area of said chains and afterwards returning said lower pressure beams to pipe gripping position; and
e. second sensor means at a second end of said apparatus for disengaging said clutch means in response to said pipe coupling or other enlargement exiting said apparatus at said second end.

7. The apparatus of claim 6, wherein said first and second sensor means includes hydraulic valves for controlling actuation of an air valve which controls the admission of supply air to said clutch means and the exhausting of air therefrom.

8. The apparatus of claim 7, wherein said clutch is driven by direct gear connection to said drive chain driving means and, when engaged with said timer means, will drive said timer means at a rate proportional to the rate which said driving means drives said pipe.

9. The apparatus of claim 8, wherein said timer means includes a timer wheel having a cam surface thereon and first and second hydraulic valves actuated thereby for automatically opening and closing said upper and lower pairs of opposed pressure beams to permit said pipe to be moved through said pathway without a coupling or enlargement therein being gripped between said drive chains while said pipe is at all times being gripped in at least one of the upper and lower gripping areas of said drive chains.

10. The apparatus of claim 9, wherein said sensor means and said timer means includes hydraulic valve means which shift when operation of the apparatus is reversed to effect reversal of flow of power fluid between said sensors and said clutch means and to said timer means so that the operation of the sensors is reversed to enable pipe couplings to be passed through the apparatus automatically as the pipe is run into the well or is withdrawn therefrom.

11. The apparatus of claim 4, 7, or 10, including spreader means for spreading apart said opposed endless drive chains at said non-gripping area.

12. The apparatus of claim 11, wherein said spreader means includes a pair of spreader members interposed between the opposed endless drive chains, one on the front side and one on the back side.

13. The apparatus of claim 12, wherein said spreader members are attached to said frame means.

14. The apparatus of claim 3, 9, or 10, including:

a. tubular quill means for surrounding the pipe or tubing, said quill means being grippable and movable longitudinally by said chain drive means; and
b. means for releasably gripping the pipe or tubing, said gripping means being supported on said quill means and movable therewith.

15. The apparatus of claim 14, incuding:

a. means for rotating said gripping means relative to said quill means; and
b. means on said apparatus engageable with said quill means for counteracting the rotational forces applied to said pipe or tubing to rotate the same.

16. A method of running coupled pipe into a well continuously using pipe injection apparatus, said pipe injection apparatus having the ability to grip the pipe at upper and lower gripping areas separated by a non-gripping area therebetween, the means for engaging and disengaging the pipe at both such gripping areas being operable independently of each other, the method including the steps of:

a. engaging the pipe in the upper and lower gripping areas of the pipe injection apparatus;
b. operating the pipe injection apparatus to move the pipe into the well;
c. disengaging the upper gripping area to allow a pipe coupling to pass freely therethrough into the non-gripping area;
d. engaging the upper gripping area with the pipe;
e. subsequently disengaging the lower gripping area to allow the pipe coupling to pass freely therethrough;
f. engaging the lower gripping area with the pipe; and
g. repeating steps "c", "d", "e", and "f".

17. The method of claim 16, including the additional steps of:

a. operating the pipe injection apparatus to withdraw the pipe from the well;
b. disengaging the lower gripping area to allow a pipe coupling to pass freely therethrough into the non-gripping area;
c. engaging the lower gripping area;
d. subsequently releasing the upper gripping area to allow the pipe coupling to pass freely therethrough;
e. engaging the upper gripping area; and
f. repeating steps "b", "c", "d", and "e".

18. The method of claim 16 or 17, wherein the engaging and disengaging of the upper and lower gripping areas of the pipe injection apparatus are performed while the pipe is moving.

19. The method of claim 18, wherein the steps of engaging and disengaging of the upper and lower gripping areas are performed automatically as the pipe is run into or out of the well.

20. The method of claim 18, including the additional step of rotating the pipe through use of quill means held in said pipe injection apparatus and supporting pipe gripping and rotating means on its upper end.

21. The method of claim 20, including the additional step of moving the pipe string longitudinally while simultaneously rotating the same.

22. The apparatus of claim 1, 2, 3, 9, or 10, including means associated with said upper and lower opposed pressure beams for limiting outward movement thereof to a predetermined intermediate location in which said drive chains will just clear a coupling on said pipe string.

23. The apparatus of claim 22, wherein said limiting means includes:

a. travel limiting members engageable in said slots of said side plates to interfere with said trunnions of said pressure beams and limit outward movement thereof; and b. means for retaining said travel limiting members engaged in said slots, said retaining means being releasable to permit said pressure beams to move to their outermost position.

24. The apparatus of claim 23, wherein said travel limiting members comprise blocks of predetermined dimension disposed one in each of said slots for limiting outward movement of said trunnions by a predetermined amount, and said retaining means comprise cover members one covering a portion of each of said slots to maintain said travel limiting members therein.

25. The apparatus of claim 11, including:

a. travel limiting members engageable in said slots of said side plates to interfere with said trunnions of said pressure beams and limit outward movement thereof; and b. means for retaining said travel limiting members engaged in said slots, said retaining means being releasable to permit said pressure beams to move to their outermost position.

26. The apparatus of claim 25, wherein said travel limiting members comprise blocks of predetermined dimension disposed one in each of said slots for limiting outward movement of said trunnions by a predetermined amount, and said retaining means comprise cover members one covering a portion of each of said slots to maintain said travel limiting members therein.

27. The apparatus of claim 13, including:

a. travel limiting members engageable in said slots of said side plates to interfere with said trunnions of said pressure beams and limit outward movement thereof; and b. means for retaining said travel limiting members engaged in said slots, said retaining means being releasable to permit said pressure beams to move to their outermost position.

28. The apparatus of claim 27, wherein said travel limiting members comprise blocks of predetermined dimension disposed one in each of said slots for limiting outward movement of said trunnions by a predetermined amount, and said retaining means comprise cover members one covering a portion of each of said slots to maintain said travel limiting members therein.

29. The apparatus of claim 15, including:

a. travel limiting members engageable in said slots of said side plates to interfere with said trunnions of said pressure beams and limit outward movement thereof; and b. means for retaining said travel limiting members engaged in said slots, said retaining means being releasable to permit said pressure beams to move to their outermost position.

30. The apparatus of claim 29, wherein said travel limiting members comprise blocks of predetermined dimension disposed one in each of said slots for limiting outward movement of said trunnions by a predetermined amount, and said retaining means comprise cover members one covering a portion of each of said slots to maintain said travel limiting members therein.

31. Apparatus for injecting pipe or tubing into a well or withdrawing it therefrom, comprising:

a. frame means; and b. endless type chain drive means mounted in said frame means for gripping and moving said pipe or tubing, said endless-type drive chain means including:

i. drive chain means including a pair of opposed endless drive chains disposed in a common plane and spaced apart providing a pathway therebetween for said pipe or tubing.

ii. opposed pressure beam means in each of said endless drive chains movable toward and away from each other to releasably force said drive chains into gripping engagement with said pipe or tubing, said pressure beams having outwardly extending trunnion means slidably disposed in slots in side plates of said frame means, iii. means for moving said opposed pressure beams toward and away from each to cause said drive chains to grip and release said pipe or tubing, iv. means for driving said drive chain means to move said pipe or tubing into or out of said well, and v. means associated with said opposed pressure beams for limiting outward movement thereof to a predetermined intermediate position in which said drive chains will just clear a coupling on said tubing.

32. The apparatus of claim 31, wherein said travel limiting means includes:

a. travel limiting members engageable in said slots of said side plates to interfere with said trunnions of said pressure beams and limit outward movement thereof; and b. means for retaining said travel limiting members engaged in said slots, said retaining means being releasable to permit said pressure beams to move to their outermost position.

33. The apparatus of claim 32, wherein said travel limiting members comprise blocks of predetermined dimension disposed one in each of said slots for limiting outward movement of said trunnions by a predetermined amount, and said retaining means comprise cover members one covering a portion of each of said slots to maintain said travel limiting members therein.

* * * * *